US006871040B2

(12) United States Patent
Tani et al.

(10) Patent No.: US 6,871,040 B2
(45) Date of Patent: Mar. 22, 2005

(54) IMAGE FORMING PROCESS AND IMAGE FORMING APPARATUS

(75) Inventors: Yoshio Tani, Shizuoka (JP); Masataka Murata, Shizuoka (JP); Sadao Okano, Kanagawa (JP)

(73) Assignees: Fuji Photo Film Co., Ltd., Kanagawa (JP); Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/679,374

(22) Filed: Oct. 7, 2003

(65) Prior Publication Data

US 2004/0146325 A1 Jul. 29, 2004

(30) Foreign Application Priority Data

Oct. 7, 2002 (JP) ..... 2002-293538

(51) Int. Cl.[7] ..... G03G 15/20
(52) U.S. Cl. ..... 399/329; 399/333; 219/216
(58) Field of Search ..... 118/60; 219/216; 399/328, 329, 330, 333

(56) References Cited

U.S. PATENT DOCUMENTS 5,115,278 A * 5/1992 Maruta et al. ..... 399/329
5,765,085 A * 6/1998 Law et al. ..... 399/329

FOREIGN PATENT DOCUMENTS

| | | |
|---|---|---|
| JP | 3-242673 | 10/1991 |
| JP | 4-51156 | 2/1992 |

* cited by examiner

*Primary Examiner*—Hoang Ngo
(74) *Attorney, Agent, or Firm*—Sughrue Mion, PLLC

(57) ABSTRACT

Provided is an image forming process which can effectively suppress the occurrence of separation electrification between a belt surface layer and an image-receiving layer of an electrophotographic image-receiving sheet at a cooling and separation unit, prevent dust from adsorbing to charges at each surface thereof, and print high quality images having near-photographic quality, in which a belt-fixing smoothing device having a heating and pressuring member, a belt member, a cooling device, and a cooling and separating unit is used to conduct fixing treatment to an electrophotographic image-receiving sheet. In this case, a surface resistivity (SR1) of one side of the image-receiving sheet on which an image is formed satisfies the formula $1.0\times10^{9}$ $\Omega/cm^2 \leqq SR1 \leqq 1.0\times10^{14}$ $\Omega/cm^2$, and a surface resistivity (SR2) of one side of the belt member which becomes in contact with the image satisfies the formula $SR2 \leqq 1.0\times10^{14}$ $\Omega/cm^2$.

21 Claims, 2 Drawing Sheets

IMAGE FORMING PROCESS AND IMAGE FORMING APPARATUS

BACKGROUND OF THE INVENTION

1. Field of the Invention

The present invention relates to an electrophotographic image forming process and image forming apparatus which effectively inhibit separation electrification (contact electrification) between a surface layer of a belt member and an image-receiving layer of an electrophotographic image-receiving sheet at a cooling and separating unit, prevent adsorption of dust to charges on the belt and the surface of the electrophotographic image-receiving sheet, and allow printing of a high quality image having a near-photograph quality.

2. Description of the Related Art

A problem in endless belt fixing is that separation electrification is induced at a belt surface layer and an image-receiving layer of an electrophotographic image-receiving sheet at a cooling and separating unit, and failures by dust adsorption to the charges at the layer surfaces are likely to occur. Particularly, the dust adhered to the belt may subsequently cause defects in image-receiving sheets and has possibility to cause a significant failure which occurs repeatedly at the same spot, and therefore a solution of this problem is desired.

For example, Japanese Patent Application Laid-Open (JP-A) No. 03-25476 discloses a fixing device that fixes a toner image by applying heat to the toner image indirectly through a film, in which the film has multiple layers each of which has a volume resistivity of $10^{11}$ Ω·cm or less so that the layer that slides over a heater is maintained substantially at a predetermined electric potential.

JP-A No. 03-242673 discloses a fixing device which has a sheet-shaped member such as a heat resistant film and a driving roller which drives this sheet-shaped member. The fixing device heats a developed image on a recording material with heat from a heater through the sheet-shaped member. The driving roller includes a metal roller and an elastic surface layer containing a conductive material coated on the metal roller, and a volume resistivity of the elastic surface layer is $10^{11}$ Ω·cm or less.

JP-A No. 04-51156 discloses a thermal fixing process that fixes a developed image formed by toner with electrophotography to a recording material, in which a surface resistivity of a film between a heater and a pressure applier is $10^{15}$ Ω/cm$^2$ or less.

JP-A No. 08-63017 discloses an image heating process in which a film having a conductive layer is used, and an eddy current is generated in the conductive layer of the film upstream of a nip to generate heat and to heat a toner image, and then after the temperature of the toner becomes lower than its glass transition point, the recording material on which the toner image is formed is separated from the film.

JP-A No. 09-190099 discloses a fixing device having a fixing roller; a driven roller; a heating belt which is mounted over the driven roller and the fixing roller; a pressuring roller which is arranged oppositely to the fixing roller and which forms a nip with the heating belt, the nip constituting a first fixing unit; and a heating source which is arranged at the fixing roller and/or the pressuring roller. The heating belt has a conductive member made of nickel or the like as a base, and a releasing material layer which is arranged on the outside of the base and contains a fluorine resin.

JP-A No. 2001-302812 discloses an endless belt whose surface resistivity is from 1×10 Ω to $1\times10^{16}$ Ω or whose volume resistivity is from 1×10 Ω·cm to $1\times10^{16}$ Ω·cm. The belt is to be used in an image forming apparatus as an intermediate transfer belt, conveyor transfer belt, or photoconductor belt.

Although JP-A Nos. 03-25476, 03-242673, and 04-51156 describe electric resistance values of fixing films, they do not describe electrophotographic image-receiving sheet at all, and moreover, they do not disclose nor imply a cooling device nor cooling separation. JP-A Nos. 08-63017 and 09-190099 do not describe specific values of conductivity, and although JP-A No. 2001-302812 describes an endless belt and defines the electric resistance thereof, the belt is not for use as a fixing belt.

At any rate, the above-mentioned disclosures do not disclose nor imply separation electrification at the time of separation, and since the separation electrification is generated between an electrophotographic image-receiving sheet and an endless belt, it is difficult to prevent dust adsorption failures by the disclosures.

When a high quality image having a near-photographic quality is to be printed, it is effective to use an electrophotographic image-receiving sheet which has polymer layers on both sides, but polymer layers are generally insulators and particularly likely to cause separation electrification, which is a significant problem. To prevent this, electric properties have to be given for both the belt surface and the electrophotographic image-receiving sheet, which determine the amount charge by separation electrification, but in prior art, no consideration has been made.

SUMMARY OF THE INVENTION

An object of the present invention is to provide an electrophotographic image forming process and image forming apparatus which can effectively suppress generation of separation electrification between a belt surface layer and an image-receiving layer of an electrophotographic image-receiving sheet at a cooling and separating unit, prevent dust adsorption failure caused by charges at each surface, and enable printing of a high quality image having a near-photographic quality by defining electric properties for both the belt surface and electrophotographic image-receiving sheet, which are the causes of the separation electrification in an endless belt fixing.

In an image forming process of the present invention, a fixing treatment is carried out on an electrophotographic image-receiving sheet using a belt-fixing smoothing device having a heating and pressuring member, a belt member, a cooling device, and a cooling and separating unit. Here, a surface resistivity (SR1) on one side of the electrophotographic image-receiving sheet to which an image is formed satisfies the formula: $1.0\times10^{9}$ Ω/cm$^2$ ≦ SR1 ≦ $1.0\times10^{14}$ Ω/cm$^2$, and a surface resistivity (SR2) on one side of a belt member of the belt-fixing smoothing device employing cooling separation which comes into contact with an image satisfies the formula: SR2 ≦ $1.0\times10^{14}$ Ω/cm$^2$. As a result, it is possible to effectively suppress generation of separation electrification between a belt surface layer and an image-receiving layer of an electrophotographic image-receiving sheet at a cooling and separating unit, prevent dust adsorption failure caused by charges at each surface, and print a high quality image having a near-photographic quality.

The image forming apparatus of the present invention uses a belt-fixing smoothing device having a heating and pressuring member, a belt member, a cooling device, and a cooling and separating unit to execute a fixing treatment to an electrophotographic image-receiving sheet, in which a surface resistivity (SR1) on one side of the electrophotographic image-receiving sheet to which an image is formed satisfies the formula: $1.0\times10^{9}$ $\Omega/cm^2 \leqq SR1 \leqq 1.0\times10^{14}$ $\Omega/cm^2$, and a surface resistivity (SR2) on one side of a belt of the belt-fixing smoothing device which comes into contact with an image satisfies the formula: $SR2 \leqq 1.0\times10^{14}$ $\Omega/cm^2$. As a result, it is possible to effectively suppress generation of separation electrification between a belt surface layer and an image-receiving layer of an electrophotographic image-receiving sheet at a cooling and separating unit, prevent dust adsorption failure caused by charges at each surface, and print a high quality image having a near-photographic quality.

Figure 1:
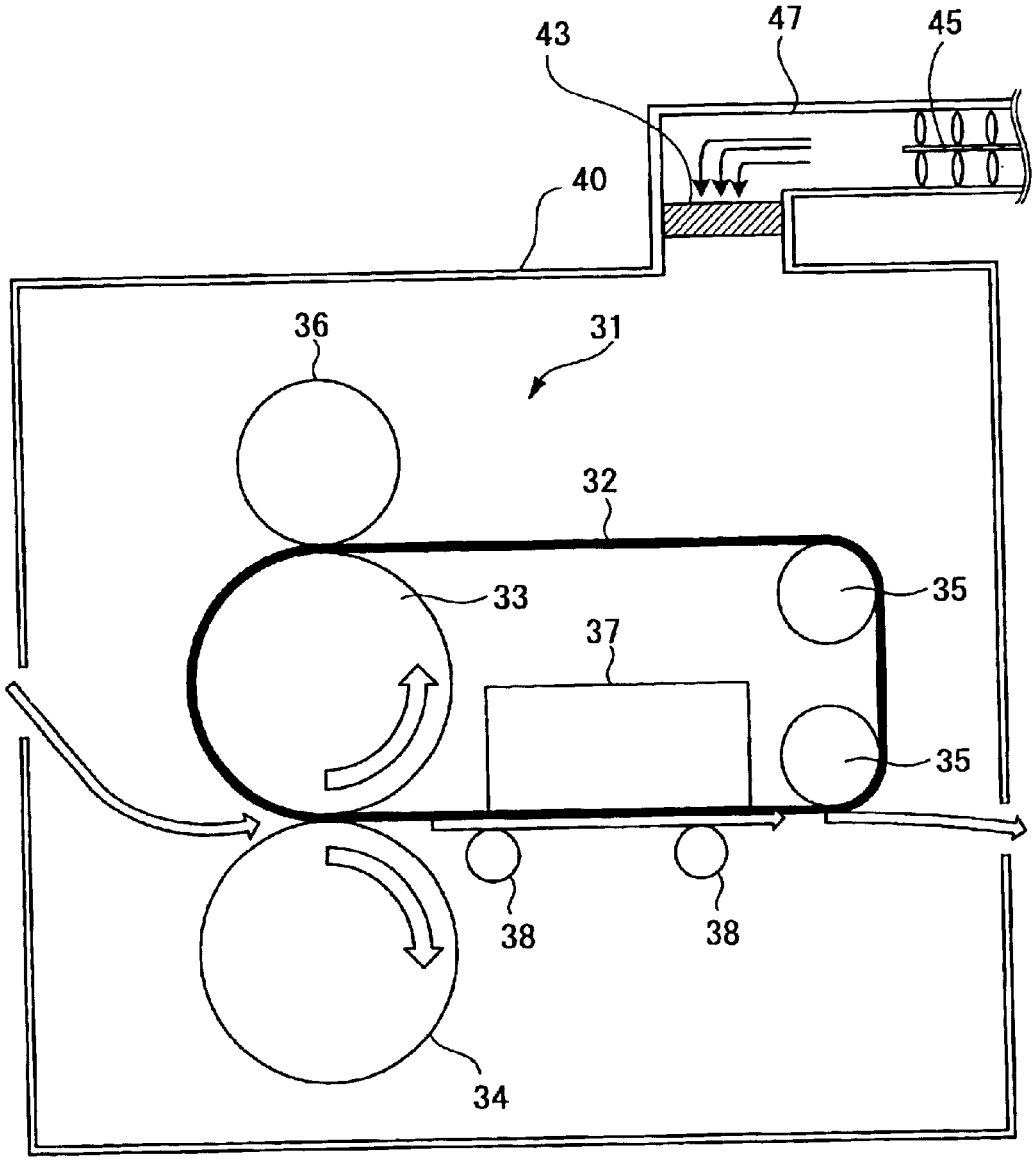
FIG. 1 is a schematic view showing an example of a belt-fixing smoothing device according to the present invention.

DESCRIPTION OF THE PREFERRED EMBODIMENTS (Image Forming Process and Image Forming Apparatus)

In an image forming process of the present invention, a fixing treatment is carried out on an electrophotographic image-receiving sheet using a belt-fixing smoothing device having a heating and pressuring member, a belt member, a cooling device, and a cooling and separating unit.

In an image forming apparatus of the present invention, a fixing treatment is carried out on an electrophotographic image-receiving sheet using a belt-fixing smoothing device having a heating and pressuring member, a belt member, a cooling device, and a cooling and separating unit.

In the present invention, by defining electric properties of the side of the electrophotographic image-receiving sheet on which an image is formed (such as a toner image-receiving layer) and the belt surface (which comes in contact with the image) of the belt-fixing smoothing device, it is possible to suppress the generation of separation electrification and prevent dust accumulation.

Preferably, a surface resistivity (SR1) on one side of the electrophotographic image-receiving sheet to which an image is formed satisfies the formula: $1.0\times10^{9}$ $\Omega/cm^2 \leqq SR1 \leqq 1.0\times10^{14}$ $\Omega/cm^2$, and more preferably it satisfies the formula: $1.0\times10^{10}$ $\Omega/cm^2 \leqq SR1 \leqq 1.0\times10^{13}$ $\Omega/cm^2$.

If the surface resistivity (SR1) of the side of the electrophotographic image-receiving sheet on which an image is formed is low, toner transfer properties will be insufficient. If it is too high, separation electrification will not be prevented.

Preferably, a surface resistivity (SR2) on one side of a belt of the belt-fixing smoothing device employing cooling separation which comes into contact with an image satisfies the formula: $SR2 \leqq 1.0\times10^{14}$ $\Omega/cm^2$, and more preferably it satisfies the formula: $1.0\times10^{9}$ $\Omega/cm^2 \leqq SR2 \leqq 1.0\times10^{13}$ $\Omega/cm^2$.

If the surface resistivity (SR2) on the side of the belt which comes into contact with an image is too low, toner may easily scatter when it touches the belt. If it is too high, separation electrification will not be prevented.

Preferably, a volume resistivity (VR) of the belt satisfies the formula: $1.0\times10^{9}$ $\Omega\cdot cm \leqq VR \leqq 1.0\times10^{14}$ $\Omega\cdot cm$, and more preferably the formula: $1.0\times10^{10}$ $\Omega\cdot cm \leqq VR \leqq 1.0\times10^{13}$ $\Omega\cdot cm$.

If the volume resistivity (VR) of the belt is too low, toner transfer properties may be insufficient. If it is too high, separation electrification may not be prevented.

The surface resistivities (SR1 and SR2) and volume resistivity (VR) of the sheet and the belt can be measured based on JIS K 6911. A sample is kept in an environment with a temperature of 20° C. and a relative humidity of 65% for at least 8 hours. Then, measurements are made using an R8340 produced by Advantest Ltd., under the same environmental conditions after giving an electric current for 1 minute at an applied voltage of 100V.

It is preferable that one or both of a support and surface coating of the belt include a conductive material and that at least one of thermoplastic resin layers on the side of the electrophotographic image-receiving sheet on which an image is formed include a conductive material.

Preferably, the conductive material consists of electron conductive particles, and their number average particle diameter is 5 $\mu$m or less, and more preferably 3 $\mu$m or less.

Examples of the electron conductive particle include carbon black, antimony oxide-doped tin oxide, tin oxide-doped indium oxide, Ni—, Ag—, or Au-plated polymer particles, and the like.

The amount of the conductive material is not particularly limited, and it may suitably be selected according to the purpose, but it is typically 0.1% by mass to 20% by mass for both the belt and the image-receiving sheet.

In the present invention, the amount of charge for each of the belt and electrophotographic image-receiving sheet after separation at the cooling and separating unit is preferably ±5 kV or less, more preferably ±3 kV or less, and still more preferably ±1 kV or less.

If the amount of charge for each of the belt and electrophotographic image-receiving sheet exceeds ±5 kV, static electricity (of the charges) adsorbs dust in the air and may cause surface defects.

Moreover, in the present invention, it is possible to employ an aspect in which each amount of charge exceeds ±5 kV immediately after the separation at the cooling and separating unit, but both the belt and the electrophotographic image-receiving sheet are discharged so as to reduce each amount of charge to ±1 kV or less.

Here, the process for discharging is not particularly limited, and it may suitably be selected according to the purpose. Examples of the discharging process include using discharge brush, discharge cloth, discharge blower, or the like.

The amount of charge of the sheet and the belt can be measured using a separation electrification measuring device (such as Statiron-DZ3 available from Shishido Electrostatic, Ltd. and the like) which is used in general.

In a process for forming an electrophotographic image of the present invention, the belt-fixing smoothing device may be covered entirely with a case except entrance and exit portions where an electrophotographic image-receiving sheet enters or exits the belt-fixing smoothing device, and dust-free air may be supplied into the case so that the inside is positively pressured. This, in effect, removes the direct cause of the surface defects and therefore is preferable.

Here, "the inside is positively pressured" means that the inside is at least not negatively pressured, for example, the difference of pressures of the inside and the outside is preferably from 0 mmAq to +2 mmAq.

In addition, it is preferable that the cleanliness of the air inside the case of the belt-fixing smoothing device be class 10000 or less, and more preferably class 1000 or less. In order to keep the inside clean and positively pressured, the case has a ventilation system which includes a fan and an air filter.

Here, "class 10000" is a measure of the cleanliness of air, in which there are 10000 or less dust particles which have diameters of 0.5 μm or more per 1 cubic foot of air.

As described above, a process for forming an electrophotographic image of the present invention executes a fixing treatment using a belt-fixing smoothing device and an electrophotographic image-receiving sheet, each having electrical properties as stated earlier. Hereafter, the electrophotographic image-receiving sheet and the belt-fixing smoothing device will be described in detail.

<Electrophotographic Image-receiving Sheet>

The electrophotographic image-receiving sheet has, on each side of a base, at least one thermoplastic resin layer and the total thickness of the thermoplastic layer (or layers) is preferably 3 μm or more, and more preferably 5 μm or more. The thermoplastic resin layer may be, other than a toner image-receiving layer, a surface protecting layer, intermediate layer, prime layer, cushion layer, electrification regulating (preventing) layer, reflective layer, tint adjusting layer, storability enhancing layer, adhesion preventing layer, anti-curling layer, smoothing layer, and the like.

Base

The base is not particularly limited, and it may suitably be selected according to the purpose, provided that it is resistant to fixing temperature and satisfies requirements in some aspects such as smoothness, whiteness, slidability, friction, electrification prevention, denting after fixing, and the like. In general, the examples of the base include, for example, photographic supports such as papers, synthetic polymers (films), and the like as described in pages 223–240 of The Basics of Photographic Engineering: Silver halide Photography by Society of Photographic Science and Technology of Japan (Corona Publishing Co., Ltd., 1979).

Specific examples of the base include paper supports such as synthetic paper (of polyolefin, polystyrene, and the like), free sheet, art paper, single- and double-side coated paper, single- and double-side cast coated paper, mixed paper which is made from synthetic resin (such as polyethylene and the like) pulp and natural pulp, Yankee paper, baryta-coated paper, wallpaper, backing paper, synthetic resin- or emulsion-impregnated paper, synthetic rubber latex-impregnated paper, synthetic resin-added paper, paper board, cellulose fiber paper, and the like; various plastic films or sheets such as polyolefin, polyvinyl chloride, polyethylene terephthalate, polystyrene methacrylate, polyethylene naphthalate, polycarbonate polyvinyl chloride, polystyrene, polypropylene, polyimide, celluloses (such as triacetyl cellulose), and the like; the same films and sheets which are additionally treated to obtain reflectivity of white color (for example, adding a pigment such as titanium oxide into the film); cloths; metals; glasses; and the like.

These may be used either alone, or in combination of two or more as a laminate.

Other examples of the base include those described in pages 29–31 of JP-A No. 62-253159, pages 14–17 of JP-A No. 01-61236, JP-A No. 63-316848, JP-A No. 02-22651, JP-A No. 03-56955, U.S. Pat. No. 5,001,033, and the like.

The base preferably has a high surface smoothness, and specifically, a surface roughness (Oken method smoothness) of the base is preferably 210 seconds or more, and more preferably 250 seconds or more.

If the surface roughness (Oken smoothness) is less than 210 seconds, an image quality of an image may be poor when the image is formed.

In the present invention, the Oken type smoothness refers to the smoothness specified by the JAPAN TAPPI No. 5 B method.

The thickness of the base is typically from 25 μm to 300 μm, preferably from 50 μm to 260 μm, and more preferably from 75 μm to 220 μm.

The stiffness of the base is not particularly limited, and it may suitably be selected according to the purpose, but it is preferable for an image-receiving paper of photographic image quality that the stiffness be close to that of a base for color silver halide photographs.

The density of the base is preferably 0.7 g/cm$^3$ or more from the viewpoint of fixing properties.

The thermal conductivity of the base is not particularly limited, and it may suitably be selected according to the purpose, but it is preferable, that the thermal conductivity be 0.50 kcal/m·h·° C. or more under the condition of 20° C. and 65% relative humidity, from the viewpoint of fixing properties.

In the present invention, thermal conductivity can be measured according to a method described in JP-A No. 53-66279 using a sheet of paper prepared according to JIS P 8111.

Various additives which are suitably selected according to the purpose may be added to the base provided that the additives do not hinder the effect of the present invention.

Examples of the additives include whitener; conductive agent; filler; pigments and dyes including, for example, titanium oxide, ultramarine blue, and carbon black; and the like.

One or both sides of the base may be given various surface treatments or priming treatments in order to improve adhesion to a layer, layers, or the like deposited on the base.

Examples of the surface treatments include embossing treatment for glossy surface, micro-structured surface described in JP-A No. 55-26507, matte surface, and silky surface; corona discharge treatment; flame treatment; glow discharge treatment; activation treatment such as, for example, plasma treatment; and the like.

Only one of these treatments may be carried out, or any of these treatments may be used in combination; for example, the activation treatment may be carried out after the embossing treatment, or the priming treatment may be acted upon after a surface treatment such as the activation treatment or the like.

The front side, the back side, or both sides of the base may be coated with a hydrophilic binder; a semiconductor metal oxide such as alumina sol, tin oxide, and the like; and an electrification preventing agent such as carbon black and the like. Specific examples of the base are supports described in, for example, JP-A No. 63-220246.

Resin Layer

The resin is not particularly limited, and it may suitably be selected according to the purpose, and examples include polyolefin, polyvinyl chloride, polyethylene terephthalate, polystyrene, polymethacrylate, polycarbonate, polyimide, triacetyl cellulose, and the like, among which polyolefin is preferable. These resins may be used alone, or in combination of two or more.

Polyolefin is generally formed using low-density polyethylene, but in order to improve heat resistance of the support, it is preferable to use polypropylene, a blend of polypropylene and polyethylene, high-density polyethylene, a blend of high-density polyethylene and low-density polyethylene, or the like. Particularly, from the viewpoint of cost, laminate applicability, and the like, it is most preferable to use a blend of high-density polyethylene and low-density polyethylene.

For the blend of high-density polyethylene and low-density polyethylene, its blending ratio (mass ratio) ranges, for example, from 1:9 to 9:1. The blending ratio is preferably from 2:8 to 8:2, and more preferably from 3:7 to 7:3. When thermoplastic layers are formed on both sides of the support, the back side of the support is preferably formed using, for example, high-density polyethylene or a blend of high-density polyethylene and low-density polyethylene. The molecular weights of the high-density polyethylene and low-density polyethylene are not particularly limited, but it is preferable that melt indices of both high-density polyethylene and low-density polyethylene be from 1.0 g/10-min to 40 g/10-min and that the polyethylenes be suitable for extrusion.

A sheet or film of these may receive a treatment to obtain reflectivity of white color. Examples of the treatment include mixing a pigment such as titanium oxide or the like in the sheet or film.

The thickness of the support is preferably 25 μm to 300 μm, more preferably 50 μm to 260 μm, and still more preferably 75 μm to 220 μm. The rigidity of the support may vary according to the purpose. It is preferred that the support used for the electrophotographic image-receiving sheet which gives photographic image quality be close to those used for color silver halide photography.

<Toner Image-receiving Layer>

The above-mentioned toner image-receiving layer receives color and/or black toners and forms an image. The toner image-receiving layer has a function to receive toner which forms an image from a developing drum or an intermediate transfer by (static) electricity or pressure in a transferring step, and to fix the image by heat or pressure in a fixing step. The toner image-receiving layer contains a thermoplastic resin as a main component, and further contains a release agent and other components.

Thermoplastic Resin

The thermoplastic resin is not particularly limited, and it may suitably be selected according to the purpose, provided that it is deformable under certain temperatures, for example during fixing, and that it accepts toner. However, a resin similar to the binder resin of a toner is preferable. Many toners employ a polyester resin or a copolymer resin such as styrene-butylacrylate, and in such case, the thermoplastic resin used for the electrophotographic image-receiving sheet preferably contains a polyester resin or a copolymer resin such as styrene-butylacrylate, more preferably 20% by mass or more of a polyester resin or a copolymer resin such as styrene-butylacrylate. Also preferable are styrene-acrylate copolymers, styrene-methacrylate copolymers, and the like.

Specific examples of the thermoplastic resins include (a) resins containing one or more ester bonds, (b) polyurethane resin and the like, (c) polyamide resin and the like, (d) polysulfone resin and the like, (e) polyvinyl chloride resin and the like, (f) polyvinyl butyral and the like, (g) polycaprolactone resin and the like, (h) polyolefin resin and the like, and other resins.

The resins containing one or more ester bonds (a) include, for example, polyester resins obtained by condensation of a dicarboxylic acid component and an alcoholic component, polyacrylate resins or polymethacrylate resins such as polymethylmethacrylate, polybutylmethacrylate, polymethylacrylate, polybutyl acrylate, or the like; polycarbonate resins, polyvinyl acetate resins, styrene acrylate resins, styrene-methacrylate copolymer resins, vinyltoluene acrylate resins, or the like. Specific examples of the dicarboxylic acid component include terephthalic acid, isophthalic acid, maleic acid, fumaric acid, phthalic acid, adipic acid, sebacic acid, azelaic acid, abietic acid, succinic acid, trimellitic acid, pyromellitic acid, and the like. More preferably, the thermoplastic resin alone satisfies the preferable physical properties. Specific examples of the alcoholic component include ethylene glycol, diethylene glycol, propylene glycol, bisphenol A, diether derivative of bisphenol A (for example, ethylene oxide diadduct of bisphenol A, propylene oxide diadduct of bisphenol A) or bisphenol S, 2-ethyl cyclohexyldimethanol, neopentyl glycol, dicyclohexyldimethanol or glycerol. These may be substituted by hydroxyl groups.

Examples can also be found in JP-A Nos. 59-101395, 63-7971, 63-7972, 63-7973 and 60-294862.

Examples of commercial products of the polyester resins include Bailon 290, Bailon 200, Bailon 280, Bailon 300, Bailon 103, Bailon GK-140 and Bailon GK-130 from Toyobo Co., Ltd; Tufton NE-382, Tufton U-5, ATR-2009 and ATR-2010 from Kao Corporation; Eritel UE3500, UE3210, XA-8153 from Unitika Ltd.; Polyester TP-220 and R-188 from The Nippon Synthetic Chemical Industry Co., Ltd., and the like.

Examples of commercial products of the above-mentioned acrylic resins include SE-5437, SE-5102, SE-5377, SE-5649, SE-5466, SE-5482, HR-169, HR-124, HR-1127, HR-116, HR-113, HR-148, HR-131, HR-470, HR-634, HR-606, HR-607, LR-1065, LR-574, LR-143, LR-396, LR-637, LR-162, LR-469, LR-216, BR-50, BR-52, BR-60, BR-64, BR-73, BR-75, BR-77, BR-79, BR-80, BR-83, BR-85, BR-87, BR-88, BR-90, BR-93, BR-95, BR-100, BR-101, BR-102, BR-105, BR-106, BR-107, BR-108, BR-112, BR-113, BR-115, BR-116, BR-117 from Mitsubishi Rayon Ltd.; Esrec P SE-0020, SE-0040, SE-0070, SE-0100, SE-1010, SE-1035 from Sekisui Chemical Co., Ltd.; Himer ST95 and ST120 from Sanyo Chemical Industries, Ltd.; and FM601 from Mitsui Chemicals, Inc., and the like.

The polyvinyl chloride resin and the like (e) include, for example, polyvinylidene chloride resin, vinyl chloride-vinyl acetate copolymer resin, vinyl chloride-vinyl propionate copolymer resin, and the like.

The polyvinyl butyral and the like (f) include, for example, polyol resins, cellulose resins such as ethyl cellulose resin and cellulose acetate resin, and the like. Examples of commercial products include ones by Denki Kagaku Kogyo Kabushikikaisha, Sekisui Chemical Co., Ltd., and the like. For polyvinyl butyral and the like, it is preferable that the amount of polyvinyl butyral contained be 70% by mass or more and the average extent of polymerization is 500 or more, and more preferably 1000 or more. Examples of commercial products include Denka Butyral 3000-1, 4000-2, 5000A, and 6000C by Denki Kagaku Kogyo Kabushikikaisha; S-LEC BL-1, BL-2, BL-S, BX-L, BM-1, BM-2, BM-5, BM-S, BH-3, BX-1, BX-7; and the like.

The polycaprolactone resin and the like (g) include, for example, styrene-maleic anhydride resin, polyacrylonitrile resin, polyether resin, epoxy resin, phenol resin, and the like.

The polyolefin resin and the like (h) include, for example, polyethylene resin, polypropylene resin, copolymer resins of olefins such as ethylene, propylene, or the like with other vinyl monomers, acrylic resins, and the like.

The thermoplastic resins may be used alone or in combination of two or more, and in addition, a mixture, a copolymer of these resins, and the like may be used.

The thermoplastic resin preferably satisfies toner image-receiving layer properties, which will be described later, when formed into a toner image-receiving layer, and more preferably satisfies the toner image-receiving layer properties by itself. It is also preferable to use in combination two or more resins which have different toner image-receiving layer properties.

The thermoplastic resin preferably has a molecular weight that is larger than that of a thermoplastic resin used in the toner. However, according to the relationship of the thermodynamic properties of the thermoplastic resin used in the toner and the properties of the resin used in the toner image-receiving layer, the relationship of the molecular weights as described above is not necessarily preferable. For example, when a softening temperature of the resin used in the toner image-receiving layer is higher than that of the thermoplastic resin used in the toner, there are cases in which molecular weight of the resin used in the toner image-receiving layer is preferably the same or smaller.

It is also preferred that the thermoplastic resin be a mixture of resins with identical compositions having different average molecular weights. The preferable relationship with molecular weights of thermoplastic resins used in toners is disclosed in JP-A No. 08-334915.

Molecular weight distribution of the thermoplastic resin is preferably wider than that of the thermoplastic resin used in the toner.

It is preferred that the thermoplastic resin satisfies the physical properties disclosed in JP-A Nos. 05-127413, 08-194394, 08-334915, 08-334916, 09-171265, 10-221877, and the like.

It is particularly preferable that the thermoplastic resin used in a toner image-receiving layer be an aqueous resin such as water-soluble resin, water-dispersible resin, or the like for the following reasons (i) and (ii).

(i) Since no organic solvent is discharged in coating and drying processes, it is excellent in environmental preservation and workability. (ii) Since many release agents such as wax are difficult to dissolve in a solvent at room temperature, often they are dispersed in a solvent (water or an organic solvent) before use. Further, an aqueous dispersion is more stable and is excellently suitable for a manufacturing process. In addition, with aqueous coating, wax bleeds on the surface more easily during the process of coating and drying, and the effects of a release agent (offset resistance, adhesion resistance, and the like) is facilitated more easily.

The aqueous resin is not particularly limited with regards to its composition, bonding structure, molecular weight, molecular weight distribution, and formation, provided that it is an aqueous resin, water-dispersible resin, or the like. Examples of substituting groups which render a resin aqueous include sulfonic acid group, hydroxyl group, carboxylic acid group, amino group, amide group, ether group, and the like.

Examples of the water-soluble resins are given on page 26 of Research Disclosure No. 17,643, page 651 of Research Disclosure No. 18,716 pp. 873–874 of Research Disclosure No. 307,105, and pp. 71–75 of JP-A No. 64-13546.

Specific examples include a vinyl pyrrolidone-vinyl acetate copolymer, styrene-vinyl pyrrolidone copolymer, styrene-maleic anhydride copolymer, water-soluble polyester, water-soluble acrylic, water-soluble polyurethane, water-soluble nylon, a water-soluble epoxy resin, and the like. Gelatin may be selected from lime treated gelatin, acid treated gelatin, or so-called delimed gelatin in which the amount of calcium and the like is reduced, and it may also be used in combination. Examples of commercial products of aqueous polyester include various Plascoat products by Goo Chemical Co., Ltd., Finetex ES series by Dainippon Ink and Chemicals Inc., and the like; and those of aqueous acrylic resins include Jurymer AT series by Nihon Junyaku Co., Ltd., Finetex 6161 and K-96 by Dainippon Ink and Chemicals Inc., Hiros NL-1189 and BH-997 by Seiko Chemical Industries Co., Ltd., and the like.

The water-dispersible resin may suitably be selected from water-dispersed resins such as water-dispersed acrylic resin, water-dispersed polyester resin, water-dispersed polystyrene resin, water-dispersed urethane resin, and the like; emulsions such as acrylic resin emulsion, polyvinyl acetate emulsion, SBR (styrene butadiene rubber) emulsion, and the like; resins and emulsions in which the thermoplastic resins of (a) to (h) are water dispersed; and copolymers thereof, mixtures thereof, and those which are cation-modified. Two or more of these may be used in combination.

Examples of commercial products of the water-dispersible resins include, for polyester resins, Vylonal series by Toyobo Co., Ltd., Pesresin A series by Takamatsu Oil & Fat Co., Ltd., Tuftone UE series by Kao Corp., Nichigo Polyester WR series by Nippon Synthetic Chemical Industry Co., Ltd., Elitel series by Unitika Ltd., and the like; and for acrylic resins, Hiros XE, KE, and PE series by Seiko Chemical Industries Co., Ltd., Jurymer ET series by Nihon Junyaku Co., Ltd., and the like.

The minimum film-forming temperature (MFT) of the polymer is preferably room temperature or higher, from the viewpoint of pre-print storage, and preferably 100° C. or lower, from the viewpoint of fixing toner particles.

It is desirable to use a self-dispersing aqueous polyester resin emulsion satisfying the following properties (1) to (4) as the above-mentioned thermoplastic resin in present invention. As this is a self-dispersing type which does not use a surfactant, its hygroscopicity is low even in a high humidity environment, its softening point is not much reduced by moisture, and offset produced during fixing, or sticking of sheets in storage, can be suppressed. Moreover, since it is aqueous, it is very environment-friendly and has excellent workability. As it uses a polyester resin which easily assumes a molecular structure with high cohesion energy, it has sufficient hardness in a storage environment, assumes a melting state of low elasticity (low viscosity) in the fixing step for electrophotography, and toner is embedded in the toner image-receiving layer so that a sufficiently high image quality is attained.

(1) The number average molecular weight (Mn) is preferably 5000 to 10000, and more preferably 5000 to 7000.
(2) The molecular weight distribution (Mw/Mn) (weight average molecular weight/number average molecular weight) is preferably 4 or less, and more preferably 3 or less.
(3) The glass transition temperature (Tg) is preferably 40° C. to 100° C., and more preferably 50° C. to 80° C.
(4) The volume average particle diameter is preferably 20 nm to 200 nm, and more preferably 40 nm to 150 nm.

Releasing Agent

The releasing agent of the present invention can be blended to the toner image-receiving layer in order to prevent offset of the toner image-receiving layer. Various types of the releasing agent can be used as long as it melts when heated to a fixing temperature, deposits on a surface of the toner image-receiving layer so that more of it is distributed at the surface of the toner image-receiving layer, and forms a layer of the releasing agent on the surface of the toner image-receiving layer when it is cooled and solidifies.

The releasing agent is at least one or more releasing agents selected from silicone compounds, fluorine compounds, wax, and matting agents. Preferably, it is at least one or more releasing agents selected from silicone oil, polyethylene wax, carnauba wax, silicone particles and polyethylene wax particles.

Specifically, the releasing agent to be used in the present invention may for example be a compound mentioned in "Properties and Applications of Wax (Revised)" by Saiwai Publishing, or in the Silicone Handbook published by THE NIKKAN KOGYO SHIMBUN. Also, the silicone compounds, fluorine compounds and wax in the toners mentioned in Japanese Patent Application Publication (JP-B) No. 59-38581, Japanese Patent Application Publication (JP-B) No. 04-32380, Japanese Patent (JP-B) No. 2838498, JP-B No. 2949558, Japanese Patent Application Laid-Open (JP-A) No. 50-117433, No. 52-52640, No. 57-148755, No. 61-62056, No. 61-62057, No. 61-118760, and JP-A No. 02-42451, No. 03-41465, No. 04-212175, No. 04-214570, No. 04-263267, No. 05-34966, No. 05-119514, No. 06-59502, No. 06-161150, No. 06-175396, No. 06-219040, No. 06-230600, No. 06-295093, No. 07-36210, No. 07-43940, No. 07-56387, No. 07-56390, No. 07-64335, No. 07-199681, No. 07-223362, No. 07-287413, No. 08-184992, No. 08-227180, No. 08-248671, No. 08-248799, No. 08-248801, No. 08-278663, No. 09-152739, No. 09-160278, No. 09-185181, No. 09-319139, No. 09-319143, No. 10-20549, No. 10-48889, No. 10-198069, No. 10-207116, No. 11-2917, No. 11-44969, No. 11-65156, No. 11-73049 and No. 11-194542 may be used. These compounds can also be used in combination of two or more.

Specifically, examples of the silicone compounds include non-modified silicone oils (specifically, dimethyl siloxane oil, methyl hydrogen silicone oil, phenyl methyl-silicone oil, or commercial products such as KF-96, KF-96L, KF-96H, KF-99, KF-50, KF-54, KF-56, KF-965, KF-968, KF-994, KF-995 and HIVAC F-4, F-5 from Shin-Etsu Chemical Co., Ltd.; SH200, SH203, SH490, SH510, SH550, SH710, SH704, SH705, SH7028A, SH7036, SM7060, SM7001, SM7706, SH7036, SH8710, SH1107 and SH8627 from Dow Corning Toray Silicone Co., Ltd.; and TSF400, TSF401, TSF404, TSF405, TSF431, TSF433, TSF434, TSF437, TSF450 series, TSF451 series, TSF456, TSF458 series, TSF483, TSF484, TSF4045, TSF4300, TSF4600, YF33 series, YF-3057, YF-3800, YF-3802, YF-3804, YF-3807, YF-3897, XF-3905, XS69-A1753, TEX100, TEX101, TEX102, TEX103, TEX104, TSW831, and the like from GE Toshiba Silicones), amino-modified silicone oils (for example, KF-857, KF-858, KF-859, KF-861, KF-864 and KF-880 from Shin-Etsu Chemical Co., Ltd., SF8417 and SM8709 from Dow Corning Toray Silicone Co., Ltd., and TSF4700, TSF4701, TSF4702, TSF4703, TSF4704, TSF4705, TSF4706, TEX150, TEX151 and TEX154 from GE Toshiba Silicones), carboxy-modified silicone oils (for example, BY16-880 from Dow Corning Toray Silicone Co., Ltd., TSF4770 and XF42-A9248 from GE Toshiba Silicones), carbinol-modified silicone oils (for example, XF42-B0970 from GE Toshiba Silicones), vinyl-modified silicone oils (for example, XF40-A1987 from GE Toshiba Silicones), epoxy-modified silicone oils (for example, SF8411 and SF8413 from Dow Corning Toray Silicone Co., Ltd.; TSF3965, TSF4730, TSF4732, XF42-A4439, XF42-A4438, XF42-A5041, XC96-A4462, XC96-A4463, XC96-A4464 and TEX170 from GE Toshiba Silicones), polyether-modified silicone oils (for example, KF-351 (A), KF-352 (A), KF-353 (A), KF-354 (A), KF-355 (A), KF-615(A), KF-618 and KF-945 (A) from Shin-Etsu Chemical Co., Ltd.; SH3746, SH3771, SF8421, SF8419, SH8400 and SF8410 from Dow Corning Toray Silicone Co., Ltd.; TSF4440, TSF4441, TSF4445, TSF4446, TSF4450, TSF4452, TSF4453 and TSF4460 from GE Toshiba Silicones), silanol-modified silicone oils, methacryl-modified silicone oil, mercapto-modified silicone oil, alcohol-modified silicone oil (for example, SF8427 and SF8428 from Dow Corning Toray Silicone Co., Ltd., TSF4750, TSF4751 and XF42-B0970 from GE Toshiba Silicones), alkyl-modified silicone oils (for example, SF8416 from Dow Corning Toray Silicone Co., Ltd., TSF410, TSF411, TSF4420, TSF4421, TSF4422, TSF4450, XF42-334, XF42-A3160 and XF42-A3161 from GE Toshiba Silicones), fluorine-modified silicone oils (for example, FS1265 from Dow Corning Toray Silicone Co., Ltd., and FQF501 from GE Toshiba Silicones), silicone rubbers and silicone fine particles (for example, SH851U, SH745U, SH55UA, SE4705U, SH502 UA&B, SRX539U, SE6770 U-P, DY38-038, DY38-047, Torayfil F-201, F-202, F-250, R-900, R-902A, E-500, E-600, E-601, E-506, BY29-119 from Dow Corning Toray Silicone Co., Ltd.; Tospearl 105, Tospearl 120, Tospearl 130, Tospearl 145, Tospearl 240 and Tospearl 3120 from GE Toshiba Silicones), silicone-modified resins (specifically, olefin resins, polyester resins, vinyl resins, polyamide resins, cellulosic resins, phenoxy resins, vinyl chloride-vinyl acetate resins, urethane resins, acrylic resins, styrene-acrylic resins, compounds in which copolymerization resins thereof are modified by silicone, and the like), and the like. Examples of the commercial products include Daiallomer SP203V, SP712, SP2105 and SP3023 from Dainichiseika Color & Chemicals Mfg. Co., Ltd.; Modiper FS700, FS710, FS720, FS730 and FS770 from NOF Corp.; Symac US-270, US-350, US-352, US-380, US- 413, US-450, Reseda GP-705, GS-30, GF-150 and GF-300 from TOAGOSEI CO., LTD.; SH997, SR2114, SH2104, SR2115, SR2202, DCI-2577, SR2317, SE4001U, SRX625B, SRX643, SRX439U, SRX488U, SH804, SH840, SR2107 and SR2115 from Dow Corning Toray Silicone Co., Ltd., YR3370, TSR1122, TSR102, TSR108, TSR116, TSR117, TSR125A, TSR127B, TSR144, TSR180, TSR187, YR47, YR3187, YR3224, YR3232, YR3270, YR3286, YR3340, YR3365, TEX152, TEX153, TEX171 and TEX172 from GE Toshiba Silicones), and reactive silicone compounds (specifically, addition reaction type, peroxide-curing type and ultraviolet radiation curing type. Commercial examples thereof include: TSR1500, TSR1510, TSR1511, TSR1515, TSR1520, YR3286, YR3340, PSA6574, TPR6500, TPR6501, TPR6600, TPR6702, TPR6604, TPR6700, TPR6701, TPR6705, TPR6707, TPR6708, TPR6710, TPR6712, TPR6721, TPR6722, UV9300, UV9315, UV9425, UV9430, XS56-A2775, XS56-A2982, XS56-A3075, XS56-A3969, XS56-A5730, XS56-A8012, XS56-B1794, SL6100, SM3000, SM3030, SM3200 and YSR3022 from GE Toshiba Silicones), and the like.

Examples of the fluorine compounds include fluorine oils (for example, Daifluoryl #1, Daifluoryl #3, Daifluoryl #10, Daifluoryl #20, Daifluoryl #50, Daifluoryl #100, Unidyne TG-440, TG-452, TG-490, TG-560, TG-561, TG-590, TG-652, TG-670U, TG- 991, TG-999, TG-3010, TG-3020 and TG-3510 from Daikin Industries, Ltd.; MF-100, MF-110, MF-120, MF-130, MF-160 and MF-160E from Tohkem Products; S-111, S-112, S-113, S-121, S-131, S-132, S-141 and S-145 from Asahi Glass Co., Ltd.; and, FC-430 and FC-431 from DU PONT-MITSUI FLUORO-CHEMICALS COMPANY, LTD.), fluoro rubbers (for example, LS63U from Dow Corning Toray Silicone Co., Ltd.), fluorine-modified resins (for example, Modepa F200, F220, F600, F220, F600, F2020, F3035 from NOF Corp.; Diaroma FF203 and FF204 from Dai Nichi Pure Chemicals; Saflon S-381, S-383, S-393, SC-101, SC-105, KH-40 and SA-100 from Asahi Glass Co., Ltd.; EF-351, EF-352, EF-801, EF-802, EF-601, TFE, TFEA, TFEMA and PDFOH from Tohkem Products; and THV-200P from Sumitomo 3M), fluorine sulfonic acid compound (for example, EF-101, EF-102, EF-103, EF- 104, EF-105, EF-112, EF-121, EF-122A, EF-122B, EF-122C, EF-123A, EF-123B, EF-125M, EF-132, EF-135M, EF-305, FBSA, KFBS and LFBS from Tohkem Products), fluorosulfonic acid, and fluorine acid compounds or salts (specifically, anhydrous fluoric acid, dilute fluoric acid, fluoroboric acid, zinc fluoroborate, nickel fluoroborate, tin fluoroborate, lead fluoroborate, copper fluoroborate, fluorosilicic acid, fluorinated potassium titanate, perfluorocaprylic acid, ammonium perfluorooctanoate, and the like), inorganic fluorides (specifically, aluminum fluoride, potassium fluoride, fluorinated potassium zirconate, fluorinated zinc tetrahydrate, calcium fluoride, lithium fluoride, barium fluoride, tin fluoride, potassium fluoride, acid potassium fluoride, magnesium fluoride, fluorinated titanic acid, fluorinated zirconic acid, ammonium hexafluorinated phosphoric acid, potassium hexafluorinated phosphoric acid, and the like).

Examples of wax, examples of the petroleum wax include paraffin wax (for example, Paraffin wax 155, Paraffin wax 150, Paraffin wax 140, Paraffin wax 135, Paraffin wax 130, Paraffin wax 125, Paraffin wax 120, Paraffin wax 115, HNP-3, HNP-5, HNP- 9, HNP-10, HNP-11, HNP-12, HNP-14G, SP-0160, SP-0145, SP-1040, SP-1035, SP-3040, SP-3035, NPS-8070, NPS-L-70, OX-2151, OX-2251, EMUSTAR-0384 and EMUSTAR-0136 from Nippon Oils and Fats Co., Ltd.; Cellosol 686, Cellosol 428, Cellosol 651-A, Cellosol A, H-803, B460, E-172, E-866, K-133, hydrin D-337 and E-139 from Chukyo Yushi Co., Ltd.; 125° paraffin, 125° FD, 130° paraffin, 135° paraffin, 135° H, 140° paraffin, 140° N, 145° paraffin and paraffin wax M from Nippon Oil Corporation), or a microcrystalline wax (for example, Hi-Mic-2095, Hi-Mic-3090, Hi-Mic-1080, Hi-Mic-1070, Hi-Mic-2065, Hi-Mic-1045, Hi-Mic-2045, EMUSTAR-0001 and EMUSTAR-042X from Nippon Oils and Fats Co., Ltd; Cellosol 967, M, from Chukyo Yushi Co., Ltd.; 155 Microwax and 180 Microwax from Nippon Oil Corporation), and petrolatum (for example, OX-1749, OX-0450, OX-0650B, OX-0153, OX-261BN, OX-0851, OX-0550, OX-0750B, JP-1500, JP-056R and JP-011P from Nippon Oils and Fats Co., Ltd.); Fischertropsch wax (for example, FT100, FT-0070 from Nippon Seiro Co., Ltd.); amidic or imidic compounds (specifically, stearamide, phthalimide anhydride, and the like, and examples include Celosol 920, B-495, Hi-micron G-270, G-110, and Hydrin D-757 from Chukyo Yushi Co., Ltd.); and the like.

Examples of the modified wax include amine-modified polypropylene (for example, QN-7700 from SANYO KASEI Co., Ltd.), acrylic acid-modified wax, fluorine-modified wax, olefin-modified wax, urethane wax (for example, NPS-6010, and HAD-5090 from Nippon Seiro Co., Ltd.), alcohol wax (for example, NPS-9210, NPS-9215, OX-1949, XO-020T from Nippon Seiro Co., Ltd.), and the like.

Examples of the hydrogenated wax include cured castor oil (for example, castor wax from Itoh Oil Chemicals Co., Ltd.), castor oil derivatives (for example, dehydrated castor oil DCO, DCO Z-1, DCO Z-3, castor oil aliphatic acid CO-FA, ricinoleic acid, dehydrated castor oil aliphatic acid DCO-FA, dehydrated castor oil aliphatic acid epoxy ester D4 ester, castor oil urethane acrylate CA-10, CA-20, CA-30, castor oil derivative MINERASOL S-74, S-80, S-203, S42X, S-321, special castor oil condensation aliphatic acid MINERASOL RC-2, RC-17, RC-55, RC-335, special castor oil condensation aliphatic acid ester MINERASOL LB-601, LB- 603, LB-604, LB-702, LB-703, #11 and L-164 from Itoh Oil Chemicals Co., Ltd.), stearic acid (for example, 12-hydroxystearic acid from Itoh Oil Chemicals Co., Ltd.), lauric acid, myristic acid, palmitic acid, behenic acid, sebacic acid (for example, sebacic acid from Itoh Oil Chemicals Co., Ltd.), undecylenic acid (for example, undecylenic acid from Itoh Oil Chemicals Co., Ltd.), heptyl acids (heptyl acids from Itoh Oil Chemicals Co., Ltd.), maleic acid, high grade maleic oils (for example, HIMALEIN DC-15, LN-10, LN-00-15, DF-20 and SF-20 from Itoh Oil Chemicals Co., Ltd.), blown oils (for example, selbonol #10, #30, #60, R40 and S-7 from Itoh Oil Chemicals Co., Ltd.), cyclopentadieneic oil (CP oil and CP oil-S from Itoh Oil Chemicals Co., Ltd., or the like) and other synthetic waxes, and the like.

Natural wax is preferably one of vegetable wax and mineral wax, and particularly preferably vegetable wax. The natural wax is also preferably a water-dispersible wax, from the viewpoint of compatibility when a water-dispersible thermoplastic resin is used as the thermoplastic resin in the toner image-receiving layer.

Examples of the vegetable wax include carnauba wax (for example, EMUSTAR AR-0413 from Nippon Seiro Co., Ltd., and Cellusol 524 from Chukyo Yushi Co., Ltd.), castor oil (purified castor oil from Itoh Oil Chemicals Co., Ltd.), rapeseed oil, soybean oil, Japan tallow, cotton wax, rice wax, sugarcane wax, candellila wax, Japan wax, jojoba oil, and the like. Of these, carnauba wax having a melting point of 70° C. to 95° C. is particularly preferable from viewpoints of providing an electrophotographic image-receiving sheet which is excellent in anti-offset properties, adhesive resistance, paper transporting properties, gloss, is less likely to cause crack and splitting, and is capable of forming a high quality image.

Examples of the animal wax include bees wax, lanolin, spermaceti, whale oil, wool wax, and the like.

Examples of the mineral wax include montan wax, montan ester wax, ozokerite, ceresin, and the like, aliphatic acid esters (Sansosizer-DOA, AN-800, DINA, DIDA, DOZ, DOS, TOTM, TITM, E-PS, nE-PS, E-PO, E-4030, E-6000, E-2000H, E-9000H, TCP, C-1100, and the like, from New Japan Chemical Co., Ltd.), and the like. Of these, montan wax having a melting point of 70° C. to 95° C. is particularly preferable from viewpoints of providing an electrophotographic image-receiving sheet which is excellent in anti-offset properties, adhesive resistance, paper transporting properties, gloss, is less likely to cause crack and splitting, and is capable of forming a high quality image.

A content of the natural wax in the toner image-receiving layer (a surface) is preferably 0.1 $g/m^2$ to 4 $g/m^2$, and more preferably 0.2 $g/m^2$ to 2 $g/m^2$.

If the content is less than 0.1 $g/m^2$, the anti-offset properties and the adhesive resistance deteriorate. If the content is more than 4 $g/m^2$, the quality of an image may deteriorate because of the excessive amount of wax.

The melting point of the natural wax is preferably 70° C. to 95° C., and more preferably 75° C. to 90° C., from a viewpoint of anti-offset properties and paper transporting properties.

The matting agent can be selected from any known matting agent. Solid particles used as matting agents can be classified into inorganic particles and organic particles. Specifically, the inorganic matting agents may be oxides (for example, silicon dioxide, titanium oxide, magnesium oxide, aluminum oxide), alkaline earth metal salts (for example, barium sulfate, calcium carbonate, and magnesium sulfate), silver halides (for example, silver chloride, and silver bromide), glass, and the like.

Examples of the inorganic matting agents can be found, for example, in West German Patent No. 2529321, the U.K. Patent Nos. 760775, 1260772, and the U.S. Pat. Nos. 1,201,905, 2,192,241, 3,053,662, 3,062,649, 3,257,206, 3,322,555, 3,353,958, 3,370,951, 3,411,907, 3,437,484, 3,523,022, 3,615,554, 3,635,714, 3,769,020, 4,021,245 and 4,029,504.

Materials of the organic matting agent include starch, cellulose ester (for example, cellulose-acetate propionate), cellulose ether (for example, ethyl cellulose) and a synthetic resin. It is preferred that the synthetic resin is insoluble or difficult to become solved. Examples of insoluble or difficult to become solved in synthetic resins include poly(meth) acrylic acid esters (for example, polyalkyl(meth)acrylate, polyalkoxyalkyl(meth)acrylate, polyglycidyl(meth) acrylate), poly(meth)acrylamide, polyvinyl ester (for example, polyvinyl acetate), polyacrylonitrile, polyolefins (for example, polyethylene), polystyrene, benzoguanamine resin, formaldehyde condensation polymer, epoxy resin, polyamide, polycarbonate, phenolic resin, polyvinyl carbazole, polyvinylidene chloride, and the like.

Copolymers which combine the monomers used in the above polymers, may also be used.

In the case of the copolymers, a small amount of hydrophilic repeated units may be included. Examples of monomers which form a hydrophilic repeated unit include acrylic acid, methacrylic acid, α,β-unsaturated dicarboxylic acid, hydroxyalkyl(meth)acrylate, sulfoalkyl (meth)acrylate, styrene sulfonic acid, and the like.

Examples of the organic matting agents can be found, for example, in the U.K. Patent No. 1055713, the U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344, 3,591,379, 3,754,924 and 3,767,448, and JP-A Nos. 49-106821, and 57-14835.

Also, two or more types of solid particles may be used in combination. The average particle size of the solid particles may be, for example, from 1 μm to 100 μm, and preferably from 4 μm to 30 μm. The usage amount of the solid particles may be from 0.01 $g/m^2$ to 0.5 $g/m^2$, and preferably from 0.02 $g/m^2$ to 0.3 $g/m^2$.

The release agent of the present invention which is added to a toner image-receiving layer may also use derivatives, oxides, refined products, or mixtures of these. These may also have reactive substituents.

The melting point (° C.) of the releasing agent is preferably 70° C. to 95° C., and more preferably 75° C. to 90° C., from the viewpoints of anti-offset properties and paper transport properties.

The releasing agent is also preferably a water-dispersible releasing agent, from the viewpoint of compatibility when a water-dispersible thermoplastic resin is used as the thermoplastic resin in the toner image-receiving layer.

The content of the releasing agent in the toner image-receiving layer is preferably 0.1% by mass to 10% by mass, more preferably 0.3% by mass to 8.0% by mass, and still more preferably 0.5% by mass to 5.0% by mass.

Other Components

Other components include various additives which are added in order to improve thermoplastic properties of a toner image-receiving layer, for example, a colorant, plasticizer, filler, cross-linking agent, electrification control agent, emulsifier, dispersant, and the like.

Examples of colorants include fluorescent whitening agents, white pigments, colored pigments, dyes, and the like.

The fluorescent whitening agent has absorption in the near-ultraviolet region, and is a compound which emits fluorescence at 400 nm to 500 nm. The various fluorescent whitening agent known in the art may be used without any particular limitation. Examples of the fluorescent whitening agent include the compounds described in "The Chemistry of Synthetic Dyes" Volume V, Chapter 8 edited by K. VeenRataraman. Specific examples of the fluorescent whitening agent include stilbene compounds, coumarin compounds, biphenyl compounds, benzo-oxazoline compounds, naphthalimide compounds, pyrazoline compounds, carbostyryl compounds, and the like. Examples of the commercial fluorescent whitening agents include WHITEX PSN, PHR, HCS, PCS, and B from Sumitomo Chemicals, UVITEX-OB from Ciba-Geigy, Co., Ltd., and the like.

Examples of the white pigments include the inorganic pigments (for example, titanium oxide, calcium carbonate, and the like).

Examples of the colored pigments include various pigments and azo pigments described in JP-A No. 63-44653, (for example, azo lakes such as carmine 6B and red 2B, insoluble azo compounds such as monoazo yellow, disazo yellow, pyrazolo orange, Balkan orange, and condensed azo compounds such as chromophthal yellow and chromophthal red), polycyclic pigments (for example, phthalocyanines such as copper phthalocyanine blue and copper phthalocyanine green), thioxadines such as thioxadine violet, isoindolinones such as isoindolinone yellow, surenes such as perylene, perinon, hulavanthoron and thioindigo, lake pigments (for example, malachite green, rhodamine B, rhodamine G and Victoria blue B), and inorganic pigment (for example, oxide, titanium dioxide, iron oxide red, sulfate; settling barium sulfate, carbonate; settling calcium carbonate, silicate; hydrous silicate, silicic anhydride, metal powder; alminium powder, bronze powder, zinc powder, carbon black, chrome yellow, iron blue, or the like) and the like.

These may be used either alone, or in combination of two or more. Of these, titanium oxide is particularly preferred as the pigment.

There is no particular limitation on the form of the pigment. However, hollow particles are preferred from the viewpoint that they have excellent heat conductivity (low heat conductivity) during image fixing.

The various dyes including oil-soluble dyes, water-insoluble dyes, and the like may be used as the dye.

Examples of oil-soluble dyes include anthraquinone compounds, azo compounds, and the like.

Examples of water-insoluble dyes include vat dyes such as C.I.Vat violet 1, C.I.Vat violet 2, C.I.Vat violet 9, C.I.Vat violet 13, C.I.Vat violet 21, C.I.Vat blue 1, C.I.Vat blue 3, C.I.Vat blue 4, C.I.Vat blue 6, C.I.Vat blue 14, C.I.Vat blue 20 and C.I.Vat blue 35, or the like; disperse dyes such as C.I. disperse violet 1, C.I. disperse violet 4, C.I. disperse violet 10, C.I. disperse blue 3, C.I. disperse blue 7, C.I. disperse blue 58, or the like; and other dyes such as C. I. solvent violet 13, C.I. solvent violet 14, C.I. solvent violet 21, C.I. solvent violet 27, C.I. solvent blue 11, C.I. solvent blue 12, C.I. solvent blue 25, C.I. solvent blue 55, or the like.

Colored couplers used in silver halide photography may also be preferably used.

A content of the colorant in the toner image-receiving layer (surface) is preferably 0.1 $g/m^2$ to 8 $g/m^2$, and more preferably 0.5 $g/m^2$ to 5 $g/m^2$.

If the content of colorant is less than 0.1 $g/m^2$, the light transmittance in the toner image-receiving layer becomes high. If it is more than 8 $g/m^2$, handling becomes more difficult, due to crack and adhesive resistance.

In the colorant, an amount of the pigment to be added is, based on the mass of the thermoplastic resin which forms the toner image-receiving layer, preferably 40% by mass or less, more preferably 30% by mass or less, and still more preferably 20% by mass or less.

The plasticizers known in the art may be used without any particular limitation. These plasticizers have the effect of adjusting the fluidity or softening of the toner image-receiving layer due to heat and/or pressure.

The plasticizer may be selected by referring to "Chemical Handbook," (Chemical Institute of Japan, Maruzen), "Plasticizers: their Theory and Application," (ed. Koichi Murai, Saiwai Shobo), "The Study of Plasticizers, Part 1" and "The Study of Plasticizers, Part 2" (Polymer Chemistry Association), or "Handbook of Rubber and Plastics Blending Agents" (ed. Rubber Digest Co.), or the like.

Examples of the plasticizers include phthalic esters, phosphate esters, aliphatic acid esters, abiethyne acid ester, abietic acid ester, sebacic acid esters, azelinic ester, benzoates, butylates, epoxy aliphatic acid esters, glycolic acid esters, propionic acid esters, trimellitic acid esters, citrates, sulfonates, carboxylates, succinic acid esters, maleates, fumaric acid esters, phthalic acid esters, stearic acid esters, and the like; amides (for example, aliphatic acid amides and sulfoamides); ethers; alcohols; lactones; polyethyleneoxy; and the like (See, for example, JP-A Nos. 59-83154, 59-178451, 59-178453, 59-178454, 59-178455, 59-178457, 62-174754, 62-245253, 61- 209444, 61-200538, 62-8145, 62-9348, 62-30247, 62-136646, 62-174754, 62-245253, 61-209444, 61-200538, 62-8145, 62-9348, 62-30247, 62-136646 and 02-235694, and the like). The plasticizers can be mixed into a resin.

The plasticizers may be polymers having relatively low molecular weight. In this case, it is preferred that the molecular weight of the plasticizer is lower than the molecular weight of the binder resin to be plasticized. Preferably, plasticizers have a molecular weight of 15000 or less, or more preferably 5000 or less. When a polymer plasticizer is used as the plasticizer, the polymer of the polymer plasticizer is the same as that of the binder resin to be plasticized. For example, when the polyester resin is plasticized, polyester having low molecular weight is preferable. Further, oligomers may also be used as plasticizers. Apart from the compounds mentioned above, there are commercially products such as, for example, Adecasizer PN-170 and PN-1430 from Asahi Denka Co., Ltd.; PARAPLEX-G-25, G-30 and G-40 from C. P. Hall; and, rosin ester 8 L-JA, ester R-95, pentalin 4851, FK 115, 4820, 830, Ruizol 28-JA, Picolastic A75, Picotex LC and Cristalex 3085 from Rika Hercules, Inc, and the like.

The plasticizer can be used as desired to relax stress and distortion (physical distortions of elasticity and viscosity, and distortions of mass balance in molecules, binder main chains or pendant portions) which are produced when toners are embedded in the toner image-receiving layer.

The plasticizer may be dispersed in micro in the toner image-receiving layer. The plasticizer may also be dispersed in micro in a state of sea-island, in the toner image-receiving layer. The plasticizer may present in the toner image-receiving layer in a state of sufficiently mixed with other components such as binder or the like.

The content of plasticizer in the toner image-receiving layer is preferably 0.001% by mass to 90% by mass, more preferably 0.1% by mass to 60% by mass, and still more preferably 1% by mass to 40% by mass.

The plasticizer may be used for the purpose of adjusting slidability (improvement of transportability by reducing friction), improving fixing part offset (release of toner or layer to the fixing part), adjusting electrification (formation of a toner electrostatic image), and the like.

The filler may be an organic or inorganic filler. Reinforcers for binder resins, bulking agents and reinforcements known in the art may be used.

The filler may be one of those described in "Handbook of Rubber and Plastics Additives" (ed. Rubber Digest Co.), "Plastics Blending Agents: Basics and Applications" (New Edition) (Taisei Co.), "The Filler Handbook" (Taisei Co.), or the like.

As the filler, various inorganic fillers (or pigments) can be used. Examples of inorganic pigments include silica, alumina, titanium dioxide, zinc oxide, zirconium oxide, micaceous iron oxide, white lead, lead oxide, cobalt oxide, strontium chromate, molybdenum pigments, smectite, magnesium oxide, calcium oxide, calcium carbonate, mullite, and the like. Among these, silica and alumina are particularly preferable. These fillers may be used either alone or in combination of two or more. It is preferred that the filler has a small particle diameter. If the particle diameter is large, the surface of the toner image-receiving layer may tend to become rough.

Examples of the silica include spherical silica and amorphous silica. The silica may be synthesized by the dry method, wet method or aerogel method. The surface of the hydrophobic silica particles may also be treated by trimethylsilyl groups or silicone. Colloidal silica is preferred. The average particle diameter of the silica is preferably 4 nm to 120 nm, and more preferably 4 nm to 90 nm.

The silica is preferably porous. The average pore size of porous silica is preferably 50 nm to 500 nm. The average pore volume per mass of porous silica is preferably from 0.5 ml/g to 3 ml/g, for example.

The alumina includes anhydrous alumina and hydrated alumina. Examples of crystallized anhydrous aluminas which may be used, are $\alpha$, $\beta$, $\gamma$, $\delta$, $\zeta$, $\eta$, $\theta$, $\kappa$, $\rho$, or $\chi$. Hydrated alumina is preferred to anhydrous alumina. The hydrated alumina may be a monohydrate or trihydrate. Monohydrates include pseudo-boehmite, boehmite and diaspore. Trihydrates include gibbsite and bayerite. The average particle diameter of alumina is preferably 4 nm to 300 nm, and more preferably 4 nm to 200 nm. Porous alumina is preferred. The average pore size of porous alumina is preferably 50 nm to 500 nm. The average pore volume per mass of porous alumina is around 0.3 ml/g to 3 ml/g.

The alumina hydrate can be synthesized by the sol-gel method, in which ammonia is added to an aluminum salt solution to precipitate alumina, or by hydrolysis of an alkali aluminate. Anhydrous alumina can be obtained by dehydrating alumina hydrate by the action of heat.

The filler is preferably from 5 parts by mass to 2000 parts by mass relative to 100 parts by mass of the dry mass of the binder of a layer to which it is added.

A cross-linking agent can be added in order to adjust the storage stability or thermoplastic properties of the toner image-receiving layer. Examples of the cross-linking agent include compounds containing two or more reactive groups in the molecule, such as an epoxy group, an isocyanate group, an aldehyde group, an active halogen group, an active methylene group, an acetylene group and other reactive groups known in the art.

The cross-linking agent may also be a compound having two or more groups capable of forming bonds such as hydrogen bonds, ionic bonds, stereochemical bonds, or the like.

The cross-linking agent may be a compound known in the art such as a coupling agent for resin, curing agent, polymerizing agent, polymerization promoter, coagulant, film-forming agent, film-forming assistant, or the like. Examples of the coupling agents include chlorosilanes, vinylsilanes, epoxysilanes, aminosilanes, alkoxyaluminum chelates, titanate coupling agents, and the like. The examples further include other agents known in the art such as those mentioned in Handbook of Rubber and Plastics Additives (ed. Rubber Digest Co.).

The charge control agent preferably adjusts transfer and adhesion of toner, and prevents charge adhesion of a toner image-receiving layer.

The charge control agent may be any charge control agent known in the art. Examples of the charge control agent include surfactants such as a cationic surfactant, an anionic surfactant, an amphoteric surfactant, a nonionic surfactant, or the like; polymer electrolytes, electroconducting metal oxides, and the like.

Examples of the surfactant include cationic charge inhibitors such as quaternary ammonium salts, polyamine derivatives, cation-modified polymethylmethacrylate, cation-modified polystyrene, or the like; anionic charge inhibitors such as alkyl phosphates, anionic polymers, or the like; and nonionic charge inhibitors such as aliphatic ester, polyethylene oxide, or the like. When the toner has a negative charge, cationic charge control agent and nonionic charge control agent, for example, are preferable.

Examples of the electroconducting metal oxides include ZnO, $TiO_2$, $SnO_2$, $Al_2O_3$, $In_2O_3$, $SiO_2$, MgO, BaO, $MoO_3$, and the like. These may be used alone, or in combination of two or more.

Moreover, the metal oxide may contain other elements. For example, ZnO may contain Al, In, or the like, $TiO_2$ may contain Nb, Ta, or the like, and $SnO_2$ may contain (or, doped with) Sb, Nb, halogen elements, or the like.

The materials used to obtain the toner image-receiving layer may also contain various additives to improve image stability when output, or to improve stability of the toner image-receiving layer itself. Examples of the additives include antioxidants, age resistors, degradation inhibitors, anti-ozone degradation inhibitors, ultraviolet ray absorbers, metal complexes, light stabilizers, preservatives, fungicide, and the like.

Examples of the antioxidants include chroman compounds, coumarane compounds, phenol compounds (for example, hindered phenols), hydroquinone derivatives, hindered amine derivatives, spiroindan compounds, and the like. The antioxidants can be found, for example, in JP-A No. 61-159644.

Examples of age resistors include those found in Handbook of Rubber and Plastics Additives, Second Edition (1993, Rubber Digest Co.), pp. 76–121.

Examples of the ultraviolet ray absorbers include benzotriazo compounds (described in the U.S. Pat. No. 3,533,794), 4-thiazolidone compounds (described in the U.S. Pat. No. 3,352,681), benzophenone compounds (described in JP-A No. 46-2784), ultraviolet ray absorbing polymers (described in JP-A No. 62-260152).

Examples of the metal complex include those described in U.S. Pat. Nos. 4,241,155, 4,245,018, 4,254,195, JP-A Nos. 61-88256, 62-174741, 63-199248, 01-75568, 01-74272, and the like.

Additives for photography known in the art may also be added to the material used to obtain the toner image-receiving layer as described above. Examples of the photographic additives can be found in the Journal of Research Disclosure (hereinafter referred to as RD) No. 17643 (December 1978), No. 18716 (November 1979) and No. 307105 (November 1989). The relevant sections are shown.

| Type of additive | RD17643 | RD18716 | RD307105 |
|---|---|---|---|
| 1. Whitener | p.24 | p.648 right column | p.868 |
| 2. Stabilizer | pp.24–25 | p.649 right column | pp.868–870 |
| 3. Light absorber (Ultraviolet ray absorber) | pp.25–26 | p.649 right column | pp.873 |
| 4. Colorant image stabilizer | p.25 | p.650 right column | p.872 |
| 5. Film hardener | p.26 | p.651 left column | p.874–875 |
| 6. Binder | p.26 | p.651 left column | p.873–874 |
| 7. Plasticizer, lubricant | p.27 | p.650 right column | p.876 |
| 8. Auxiliary application agent (Surfactant) | pp.26–27 | p.650 right column | pp.875–876 |
| 9. Antistatic agent | p.27 | p.650 right column | p.876–877 |
| 10. Matting agent | | | pp.878–879 |

The toner image-receiving layer of the present invention is formed by applying a coating solution which contains the polymer used for the toner image-receiving layer with a wire coater or the like onto the support, and drying the coating solution. The coating solution is prepared by dissolving or uniformly dispersing an additive such as a thermoplastic polymer, a plasticizer, or the like, into an organic solvent such as alcohol, ketone, or the like. The organic solvent used here may for example be methanol, isopropyl alcohol, methyl ethyl ketone, or the like. If the polymer used for the toner image-receiving layer is water-soluble, the toner image-receiving layer can be prepared by applying an aqueous solution of the polymer onto the support. Polymers which are not water-soluble may be applied onto the support in an aqueous dispersion.

The film-forming temperature of the polymer used in the present invention is preferably room temperature or higher, from the viewpoint of pre-print storage, and preferably 100° C. or lower, from the viewpoint of fixing toner particles.

The toner image-receiving layer of the present invention is coated so that the amount of coating in mass after drying is preferably 1 $g/m^2$ to 20 $g/m^2$, and more preferably 4 $g/m^2$ to 15 $g/m^2$.

There is no particular limitation on the thickness of the toner image-receiving layer. However, it is preferably 1 $\mu$m to 30 $\mu$m, and more preferably 2 $\mu$m to 20 $\mu$m.

Physical Properties of Toner Image-receiving Layer

The 180° separation strength of the toner image-receiving layer at the fixing temperature by the fixing member is preferably 0.1 N/25 mm or less, and more preferably 0.041 N/25 mm or less. The 180° separation strength can be measured based on the method described in JIS K6887 using the surface material of the fixing member.

It is preferred that the toner image-receiving layer has a high degree of whiteness. This whiteness is measured by the method specified in JIS P 8123, and is preferably 85% or more. It is preferred that the spectral reflectance is 85% or more in the wavelength of 440 nm to 640 nm, and that the difference between the maximum spectral reflectance and minimum spectral reflectance in this wavelength is within 5%. Further, it is preferred that the spectral reflectance is 85% or more in the wavelength of 400 nm to 700 nm, and that the difference between the maximum spectral reflectance and the minimum spectral reflectance in the wavelength is within 5%.

Specifically, for the whiteness, the value of L* is preferably 80 or higher, more preferably 85 or higher, and still more preferably 90 or higher in a CIE 1976 (L*a*b*) color space. The color tint of the white color is preferably as neutral as possible. Regarding the color tint of the whiteness, the value of $(a^*)^2+(b^*)^2$ is preferably 50 or less, more preferably 18 or less and still more preferably 5 or less in a (L*a*b*) space.

It is preferred that the toner image-receiving layer has a high surface gloss. The 45° gloss luster is preferably 60 or higher, more preferably 75 or higher, and still more preferably 90 or higher, over the whole range from white where there is no toner, to black where toner is densed at maximum.

However, the gloss luster is preferably 110 or less. If it is more than 110, the image has a metallic appearance which is undesirable.

Gloss luster may be measured by JIS Z 8741.

It is preferred that the toner image-receiving layer has a high smoothness. The arithmetic average roughness (Ra) is preferably 3 μm or less, more preferably 1 μm or less, and still more preferably 0.5 μm or less, over the whole range from white where there is no toner, to black where toner is densed at maximum.

Arithmetic average roughness may be measured by JIS B 0601, B 0651, and B 0652.

It is preferred that the toner image-receiving layer has one of the following physical properties, more preferred that it has several of the following physical properties, and most preferred that it has all of the following physical properties.

(1) Tm (Melting temperature) of the toner image-receiving layer is 30° C. or more, and equal to or less than Tm+20° C. of the toner.

(2) The temperature at which the viscosity of the toner image-receiving layer is $1\times10^5$ cp is 40° C. or higher, and lower than the corresponding temperature for the toner.

(3) At a fixing temperature of the toner image-receiving layer, the storage elasticity modulus (G') is $1\times10^2$ Pa to $1\times10^5$ Pa, and the loss elasticity modulus (G") is $1\times10^2$ Pa to $1\times10^5$ Pa.

(4) The loss tangent (G"/G'), which is the ratio of the loss elasticity modulus (G") and the storage elasticity modulus (G') at a fixing temperature of the toner image-receiving layer, is 0.01 to 10.

(5) The storage modulus (G') at a fixing temperature of the toner image-receiving layer is minus 50 to plus 2500, relative to the storage elasticity modulus (G") at a fixing temperature of the toner.

(6) The inclination angle on the toner image-receiving layer of the molten toner is 50° or less, and particularly preferably 40° or less.

The toner image-receiving layer preferably satisfies the physical properties described in Japanese Patent No. 2788358, and JP-A Nos. 07-248637, 08-305067 and 10-239889.

Layers other than the toner image-receiving layer of the electrophotographic image-receiving sheet include, for example, a surface protective layer, intermediate layer, backing layer, contact improving layer, undercoat, cushion layer, charge control (inhibiting) layer, reflecting layer, tint adjusting layer, storage ability improving layer, anti-adhering layer, anti-curl layer, smoothing layer, and the like. These layers may have a single-layer structure or may be formed of two or more layers.

The thickness of the electrophotographic image-receiving sheet can be suitably selected according to the purpose without particular limitation. The thickness is preferably 50 μm to 350 μm, and more preferably 100 μm to 280 μm.

A surface protective layer may be disposed on the surface of the toner image-receiving layer to protect the surface of the electrophotographic image-receiving sheet, to improve storage properties, to improve ease of handling, to facilitate writing, to improve paper transporting properties within an equipment, to confer anti-offset properties, or the like. The surface protective layer may comprise one layer, or two or more layers. In the surface protective layer, various thermoplastic resins or thermosetting resins may be used as binders, and are preferably the same types of resins as those of the toner image-receiving layer. However, the thermodynamic properties and electrostatic properties are not necessarily identical to those of the toner image-receiving layer, and may be individually optimized.

The surface protective layer may comprise the various additives described above which can be used for the toner image-receiving layer. In particular, in addition to the releasing agents for the present invention, the surface protective layer may include other additives, for example matting agents or the like. The matting agents may be any of these used in the related art.

From the viewpoint of fixing properties, it is preferred that the outermost surface layer of the electrophotographic image-receiving sheet (which refers to, for example, the surface protective layer, if disposed) has good compatibility with the toner. Specifically, it is preferred that the contact angle with molten toner is, for example, from 0° to 40°.

It is preferred that, in the electrophotographic image-receiving sheet, a backing layer is disposed on the opposite surface to the surface on which the support is disposed, in order to confer back surface output compatibility, and to improve back surface output image quality, curl balance and paper transporting properties within equipment.

There is no particular limitation on the color of the backing layer. However, if the electrophotographic image-receiving sheet of the invention is a double-sided output image-receiving sheet where an image is formed also on the back surface, it is preferred that the backing layer is also white. It is preferred that the whiteness and spectral reflectance are 85% or more, for both the top surface and the back surface.

To improve double-sided output compatibility, the backing layer may have an identical structure to that of the toner image-receiving layer. The backing layer may comprise the various additives described hereintofore. Of these additives, matting agents and charge control agents are particularly suitable. The backing layer may be a single layer, or may have a laminated structure comprising two or more layers.

Further, if releasing oil is used for the fixing roller or the like, to prevent offset during fixing, the backing layer may have oil absorbing properties.

In the electrostatic image-receiving sheet, it is preferred to dispose a contact improving layer in order to improve the contact between the support and the toner image-receiving layer. The contact improving layer may contain the various additives described above. Of these, cross-linking agents are particularly preferred to be blended in the contact improving layer. Furthermore, to improve accepting properties to toner, it is preferred that the electrophotographic image-receiving sheet further comprises a cushion layer between the contact improving layer and the toner image-receiving layer.

An intermediate layer may for example be disposed between the support and a contact improvement layer, between a contact improvement layer and a cushion layer, between a cushion layer and a toner image-receiving layer, or between a toner image-receiving layer and a storage property improvement layer. In the case of an electrophotographic image-receiving sheet comprising a support, a toner image-receiving layer and an intermediate layer, the intermediate layer may of course be disposed for example between the support and the toner image-receiving layer.

<Toner>

In the electrophotographic image-receiving sheet, the toner image-receiving layer receives toners during printing or copying.

The toner contains at least a binder resin and a colorant, but may contain releasing agents and other components, if necessary.

Binder Resin for Toner

Examples of the binder resin include vinyl monopolymer of: styrenes such as styrene, parachlorostyrene, or the like; vinyl esters such as vinyl naphthalene, vinyl chloride, vinyl bromide, vinyl fluoride, vinyl acetate, vinyl propioniate, vinyl benzoate, vinyl butyrate, or the like; methylene aliphatic carboxylates such as methyl acrylate, ethyl acrylate, n-butyl acrylate, isobutyl acrylate, dodecyl acrylate, n-octyl acrylate, 2-chloroethyl acrylate, phenyl acrylate, α-methyl chloroacrylate, methyl methacrylate, ethyl methacrylate, butyl acrylate, or the like; vinyl nitriles such as acryloniotrile, methacrylonitrile, acrylamide, or the like; vinyl ethers such as vinyl methyl ether, vinyl ethyl ether, vinyl isobutyl ether, or the like;

N-vinyl compounds such as N-vinyl pyrrole, N-vinylcarbazole, N-vinyl indole, N-vinyl pyrrolidone, or the like; and vinyl carboxylic acids such as methacrylic acid, acrylic acid, cinnamic acid, or the like. These vinyl monomers may be used either alone, or copolymers thereof may be used. Further, various polyesters may be used, and various waxes may be used in combination.

Of these resins, it is preferable to use a resin of the same type as the resin used for the toner image-receiving layer of the present invention.

Colorants for the Toner

The colorants generally used in the art can be used without limitation. Examples of the colorants include various pigments such as carbon black, chrome yellow, Hansa yellow, benzidine yellow, threne yellow, quinoline yellow, permanent orange GTR, pyrazolone orange, Balkan orange, watch young red, permanent red, brilliant carmin 3B, brilliant carmin 6B, dippon oil red, pyrazolone red, lithol red, rhodamine B lake, lake red C, rose bengal, aniline blue, ultramarine blue, chalco oil blue, methylene blue chloride, phthalocyanine blue, phthalocyanine green, malachite green oxalate, or the like. Various dyes may also be added such as acridine, xanthene, azo, benzoquinone, azine, anthraquinone, thioindigo, dioxadine, thiadine, azomethine, indigo, thioindigo, phthalocyanine, aniline black, polymethine, triphenylmethane, diphenylmethane, thiazine, thiazole, xanthene, or the like. These colorants may be used either alone, or in combination of a plurality of colorants.

It is preferred that the content of the colorant is 2% by mass to 8% by mass. If the content of colorant is 2% by mass or more, the coloration does not become weaker. If it is 8% by mass or less, transparency does not deteriorate.

Releasing Agent for the Toner

The releasing agent may be in principle any of the wax known in the art. Polar wax containing nitrogen such as highly crystalline polyethylene wax having relatively low molecular weight, Fischertropsch wax, amide wax, urethane wax, and the like are particularly effective. For polyethylene wax, it is particularly effective if the molecular weight is 1000 or less, and is effective more preferably if the molecular weight is 300 to 1000.

Compounds containing urethane bonds have a solid state due to the strength of the cohesive force of the polar groups even if the molecular weight is low, and as the melting point can be set high in view of the molecular weight, they are suitable. The preferred molecular weight is 300 to 1000. The initial materials may be selected from various combinations such as a diisocyane acid compound with a mono-alcohol, a monoisocyanic acid with a mono-alcohol, dialcohol with mono-isocyanic acid, tri-alcohol with a monoisocyanic acid, and a triisocyanic acid compound with mono-alcohol. However, in order to prevent the molecular weight from becoming too large, it is preferable to combine a compound having multiple functional groups with another compound having one functional group, and it is important that the amount of functional groups be equivalent.

Among the initial materials, examples of the monoisocyanic acid compounds include dodecyl isocyanate, phenyl isocyanate and derivatives thereof, naphthyl isocyanate, hexyl isocyanate, benzyl isocyanate, butyl isocyanate, allyl isocyanate, and the like.

Examples of the diisocyanic acid compounds include tolylene diisocyanate, 4'-diphenylmethane diisocyanate, toluene diisocyanate, 1,3-phenylene diisocyanate, hexamethylene diisocyanate, 4-methyl-m-phenylene diisocyanate, isophorone diisocyanate, and the like.

Examples of the mono-alcohol include ordinary alcohols such as methanol, ethanol, propanol, butanol, pentanol, hexanol, heptanol, and the like.

Among the initial materials, examples of the di-alcohols include numerous glycols such as ethylene glycol, diethylene glycol, triethylene glycol, trimethylene glycol, or the like; and examples of the tri-alcohols include trimethylol propane, triethylol propane, trimethanolethane, and the like. The present invention is not necessarily limited these examples, however.

These urethane compounds may be mixed with the resin or the colorant during kneading, as an ordinary releasing agent, and used also as a kneaded-crushed toner. Further, in a case of using an emulsion polymerization cohesion scorification toner, the urethane compounds may be dispersed in water together with an ionic surfactant, polymer acid or polymer electrolyte such as a polymer base, heated above the melting point, and converted to fine particles by applying an intense shear in a homogenizer or pressure discharge dispersion machine to manufacture a releasing agent particle dispersion of 1 μm or less, which can be used together with a resin particle dispersion, colorant dispersion, or the like.

Toner, Other Components

The toner of the present invention may also contain other components such as internal additives, charge control agents, inorganic particles, or the like. Examples of the internal additives include metals such as ferrite, magnetite, reduced iron, cobalt, nickel, manganese, or the like; alloys or magnets such as compounds containing these metals.

Examples of the charge control agents include dyes such as quaternary ammonium salt, nigrosine compounds, dyes made from complexes of aluminum, iron and chromium, or triphenylmethane pigments. The charge control agent can be selected from the ordinary charge control agent. Materials which are difficult to become solved in water are preferred from the viewpoint of controlling ionic strength which affects cohesion and stability during melting, and the viewpoint of less waste water pollution.

The inorganic fine particles may be any of the external additives for toner surfaces generally used, such as silica, alumina, titania, calcium carbonate, magnesium carbonate, tricalcium phosphate, or the like. It is preferred to disperse these with an ionic surfactant, polymer acid or polymer base.

Surfactants can also be used for emulsion polymerization, seed polymerization, pigment dispersion, resin particle dispersion, releasing agent dispersion, cohesion or stabilization thereof. For example, it is effective to use, in combination, anionic surfactants such as sulfuric acid ester salts, sulfonic acid salts, phosphoric acid esters, soaps, or the like; cationic surfactants such as amine salts, quaternary ammonium salts, or the like; or non-ionic surfactants such as polyethylene glycols, alkylphenol ethylene oxide adducts, polybasic alcohols, or the like. These may generally be dispersed by a rotary shear homogenizer or a ball mill, sand mill, dyno mill, or the like, all of which contain the media.

The toner may also contain an external additive, if necessary. Examples of the external additive include inorganic powder, organic particles, and the like. Examples of the inorganic particles include $SiO_2$, $TiO_2$, $Al_2O_3$, CuO, ZnO, $SnO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and the like. Examples of the organic particles include aliphatic acids, derivatives thereof, and the like, powdered metal salts thereof, and resin powders such as fluorine resin, polyethylene resin, acrylic resin, or the like. The average particle diameter of the powder may be, for example, 0.01 $\mu$m to 5 $\mu$m, and is more preferably 0.1 $\mu$m to 2 $\mu$m.

There is no particular limitation on the process of manufacturing the toner, but it is preferably manufactured by a process comprising the steps of (i) forming cohesive particles in a dispersion of resin particles to manufacture a cohesive particle dispersion, (ii) adding a fine particle dispersion to the cohesive particle dispersion so that the fine particles adhere to the cohesive particles, thus forming adhesion particles, and (iii) heating the adhesion particles which melt to form toner particles.

Physical Properties for Toner

It is preferred that the volume average particle diameter of the toner of the present invention is from 0.5 $\mu$m to 10 $\mu$m.

If the volume average particle diameter of the toner is too small, it may have an adverse effect on handling of the toner (supplementation, cleaning properties, fluidability, or the like), and productivity of the particles may deteriorate. On the other hand, if the volume average particle diameter is too large, it may have an adverse effect on image quality and resolution, both of which lead to granulariness and transferring properties.

It is preferred that the toner of the present invention satisfies the above volume average particle diameter range, and that the volume average particle distribution index (GSDv) is 1.3 or less.

It is preferred that the ratio (GSDv/GSDn) of the volume average polymer distribution index (GSDv) and the number average particle distribution index (GSDn) is 0.95 or more.

It is preferred that the toner of the present invention satisfies the volume average particle diameter range, and that the average value of the formation coefficient expressed by the following equation is 1.00 to 1.50:

$$\text{Formation coefficient}=(\Pi\times L^2)/(4\times S)$$

(Where "L" represents the length of the toner particle and "S" represents the projected area of the toner particle.)

If the toner satisfies the above conditions, it has a desirable effect on image quality, and in particular, on granulariness and resolution. Also, there is less risk of dropout and blur accompanying with toner transferring, and less risk of adverse effect on handling properties, even if the average particle diameter is not small.

The storage elasticity modulus G' (measured at an angular frequency of 10 rad/sec) of the toner itself at 150° C. is 10 Pa to 200 Pa, which is suitable for improving image quality and preventing offset at a fixing step.

<Belt-fixing Smoothing Device>

The belt-fixing smoothing device includes a heating and pressuring member; a belt member; a cooling device; a cooling and separating unit; a case which covers the entire belt-fixing smoothing unit except entrance and exit portions where an electrophotographic image-receiving sheet enters or exits the belt-fixing smoothing device; means to supply dust-free air into the case so that the inside is positively pressured; and other members if necessary.

The heating and pressuring member is not particularly limited. Examples thereof include a combination of a heating roller, a pressuring roller, and an endless belt. The cooling device is not particularly limited. Examples thereof include a cooling device which can blow cool air and adjust cooling temperature, a heat sink, and the like.

The cooling and separating unit is not particularly limited, and it may suitably be selected according to the purpose. It typically has a spot near a tension roller where an electrophotographic image-receiving sheet separates from a belt by rigidity (elasticity) of the sheet itself.

The belt fixing method may for example be the oilless apparatus for electrophotography as described in JP-A No. 11-352819, or the method where a secondary transfer and fixing are realized simultaneously as described in JP-A Nos. 11-231671 and 05-341666. An apparatus for electrophotography having a fixing belt according to the present invention may be an apparatus for electrophotography including for example at least a heating and pressurizing part which can melt and pressurize the toner, a fixing belt which can transport an image-receiving material with adhering toner while in contact with the toner image-receiving layer, and a cooling part which can cool the heated image-receiving material while it is still adhering to the fixing belt. By using the electrophotographic image-receiving material having the toner image-receiving layer in the apparatus for electrophotography which includes the fixing belt, toner adhering to the toner image-receiving layer is fixed in fine detail without spreading onto the image-receiving material, and the molten toner is cooled and solidified, while adhering closely to the fixing belt. In this way, the toner is received onto the electrophotographic image-receiving sheet with completely embedded in the toner image-receiving layer. Therefore, there are no image discrepancies, and a glossy and smooth toner image is obtained.

The electrophotographic image-receiving sheet of the present invention is particularly suitable for forming an image by the oilless belt fixing method, and it permits a large improvement of offset. However, other methods for forming an image may also likewise be used.

For example, by using the electrophotographic image-receiving sheet of the present invention, a full-color image can easily be formed while improving image quality and preventing cracks. A full-color image can be formed using an apparatus for electrophotography capable of forming full-color images. An ordinary apparatus for electrophotography includes an image-receiving paper transporting part, latent image-forming part, and developing part disposed in the vicinity of the latent image-forming part.

To improve image quality, adhesive transfer or heat assistance transfer may be used instead of the electrostatic transfer or bias roller transfer, or in combination therewith. Specific details of these methods are given for example in JP-A Nos. 63-113576 and 05-341666. It is particularly preferred to use an intermediate transfer belt in the heat assistance transfer method. Also, it is preferred to provide a cooling device for the intermediate belt after toner transfer or in the latter half of the toner transfer to the electrophotographic image-receiving sheet. Due to this cooling device, the toner (toner image) is cooled to the softening point of the binder resin or lower, or the glass transition temperature of the toner or less, hence the image is transferred to the electrophotographic image-receiving sheet efficiently and can be separated away from the intermediate transfer belt.

The fixing is an important step that influences the glossiness and the smoothness of the toner image in a final state. The fixing method may be carried out by a heating and pressurizing roller, or belt fixing using a belt, but from the viewpoint of image quality such as gloss and smoothness, belt fixing is preferred. Belt fixing methods known in the art include for example an oil-less belt fixing described in JP-A No. 11-352819, and the method where secondary transfer and fixing are realized simultaneously as described in JP-A Nos. 11-231671 and 05-341666. Further, a primary fixing may also be performed by a heat roller before the heating and pressurizing by the fixing belt and fixing roller.

FIG. 1 shows an example of the belt-fixing smoothing device. A smoothing unit 31 of a belt device (endless press) employing cooling separation includes a belt 32, a heating roller 33, a pressuring roller 34, a tension roller 35, a cleaning roller 36, a cooling device 37, a transporting roller 38, and a case 40 which covers the entire belt-fixing smoothing device except entrance and exit portions where an electrophotographic image-receiving sheet enters and exits. In order to keep the inside clean and positively pressured, the case 40 has a duct 47 which includes an air filter 45 and a fan 43.

On the inner side of the belt 32, the belt 32 and a pair of tension rollers 35 are arranged. The belt 32 is rotatably mounted around the heating roller 33 and the pair of tension rollers 35 which are placed apart from the heating roller 33. The pressuring roller 34 is arranged so as to be in contact with the belt 32 and opposing the heating roller 33. Between the pressuring roller 34 and the belt 32 is a nip portion where the pressuring roller 34 and the heating roller 33 apply pressure. The cooling device 37 is arranged on the inner side of the belt 32, and in relation to the rotating direction of the belt 32, between the heating roller 33 positioned upstream and the tension rollers 35 positioned downstream. For the transporting rollers 38, two of them are arranged so as to oppose the cooling device 37 through the belt 32. Here, the space between the two transporting rollers is substantially the same distance as the distance between the nip portion and one of the transporting rollers 38 and the distance between the tension roller 35 and the other transporting roller 38. The cleaning roller 36 is arranged so as to oppose the heating roller 33 through the belt 32 on the opposite side of where the pressuring roller 34 is opposing the heating roller 33. The cleaning roller 36 and the heating roller 33 apply pressure to a portion between the cleaning roller 36 and the belt 32. The heating roller 33, pressuring roller 34, tension roller 35, cleaning roller 36, and transporting rollers 38 rotate in combination with one another so as to rotate the belt 32.

The belt member is preferably an endless belt comprising polyimide, electroforming nickel and aluminum as a base material.

A thin layer formed of at least one selected from silicone rubber, fluorine rubber, a silicone resin, and fluorine resin. At least one selected the aforementioned is disposed on a surface of the belt member. Of these, it is preferred to dispose a layer of fluorocarbon siloxane rubber on the surface of the fixing belt, or to dispose a layer of silicone rubber on the surface of the belt member, and then to dispose a layer of fluorocarbon siloxane rubber on the surface of the layer of silicone rubber.

It is preferred that the fluorocarbon siloxane rubber has a perfluoroalkyl ether group and/or a perfluoroalkyl group in a main chain thereof.

For the fluorocarbon siloxane rubber, a cured product of fluorocarbon siloxane rubber composition which contains the following Components (A) to (D) is preferable.

Component (A), a fluorocarbon polymer having a fluorocarbon siloxane expressed by the following General Formula (1) as its main component, and containing aliphatic unsaturated groups; Component (B), an organopolysiloxane and/or fluorocarbon siloxane containing two or more SiH groups in one molecule, and 1 to 4 times more the molar amount of SiH groups than the amount of aliphatic unsaturated groups in the fluorocarbon siloxane rubber; Component (C), a filler; and Component (D), an effective amount of catalyst; and the like.

The fluorocarbon polymer of Component (A) comprises a fluorocarbon siloxane containing a repeated unit expressed by the following General Formula (1) as its main component, and contains aliphatic unsaturated groups.

General Formula (1)

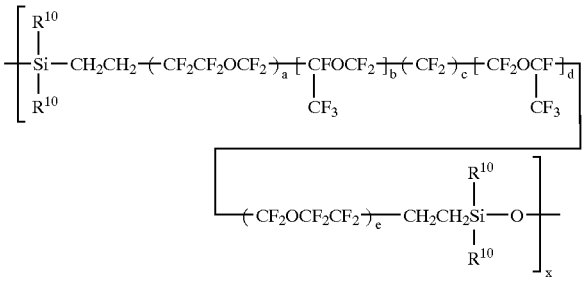

Herein, in the General Formula (1), $R^{10}$ is a non-substituted or substituted monofunctional hydrocarbon group containing 1 to 8 carbon atoms, preferably an alkyl group containing 1 to 8 carbon atoms or an alkenyl group containing 2 to 3 carbon atoms, and particularly preferably a methyl group.

"a" and "e" are, independent of the other, an integer of 0 or 1. "b" and "d" are independently an integer of 1 to 4. "c" is an integer of from 0 to 8. "x" is preferably 1 or greater, and more preferably from 10 to 30.

An example of this Component (A) include a substance expressed by the following General Formula (2):

General Formula (2)

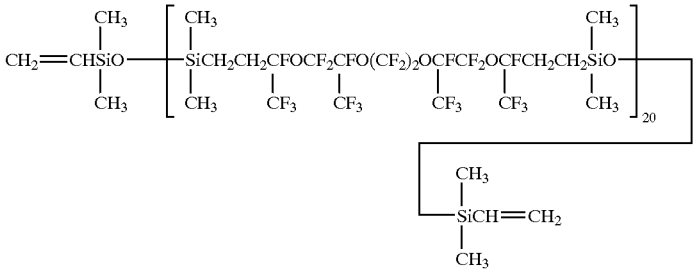

In Component (B), one example of the organopolysiloxane comprising SiH groups is an organohydrogenpolysiloxane having at least two hydrogen atoms bonded to silicon atoms in the molecule.

In the fluorocarbon siloxane rubber composition, when the organocarbon polymer of Component (A) comprises an aliphatic unsaturated group, the organohydrogenpolysiloxane is preferably used as a curing agent. That is, the cured product is formed by an addition reaction between aliphatic unsaturated groups in the fluorocarbon siloxane, and hydrogen atoms bonded to silicon atoms in the organohydrogenpolysiloxane.

Examples of these organohydrogenpolysiloxanes include the various organohydrogenpolysiloxanes used in an addition-curing silicone rubber composition.

It is generally preferred that the organohydrogenpolysiloxane is blended in such a proportion that the number of "SiH groups" therein is at least one, and particularly 1 to 5, relative to one aliphatic unsaturated hydrocarbon group in the fluorocarbon siloxane of Component (A).

It is preferred that in the fluorocarbon containing SiH groups, one unit of the General Formula (1) or $R^{10}$ in the General Formula (1) is a dialkylhydrogensiloxane group, the terminal group is an SiH group such as a dialkylhydrogensiloxane group, a silyl group, or the like. An example of the fluorocarbon includes those expressed by the following General Formula (3).

preferred to dissolve these complexes in an alcohol solvent, an ether solvent, a hydrocarbon solvent, or the like.

The fluorocarbon siloxane rubber composition is not particularly limited, and it may suitably be selected according to the purpose and may include various additives. For example, dispersing agents such as diphenylsilane diol, low polymer chain end hydroxyl group-blocked dimethylpolysiloxane, hexamethyl disilazane, heat resistance improvers such as ferrous oxide, ferric oxide, cerium oxide, octyl acid iron, or the like; and colorants such as pigments or the like, may be added as a compounding agent, if necessary.

Various blending agents may be added to the fluorocarbon siloxane rubber composition of the present invention, to the extent that the blending agents do not interfere with the purpose of the present invention which is to improve solvent resistance. For example, dispersing agents such as diphenylsilane diol, low polymer chain end hydroxyl group-blocked dimethylpolysiloxane, hexamethyl disilazane, heat resistance improvers such as ferrous oxide, ferric oxide, cerium oxide, octyl acid iron, or the like; and colorants such as pigments or the like, may be added as a compounding agent, if necessary.

The belt member of the present invention is obtained by coating the surface of a heat resistant resin or metal belt with the fluorocarbon siloxane rubber composition, and heat and cure it. The composition may be diluted to form a coating General Formula (3)

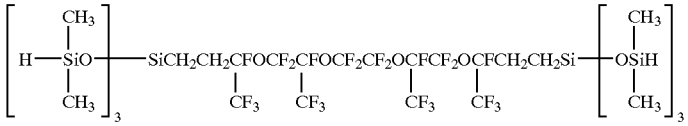

The filler, which is Component (C), may be various fillers used in ordinary silicone rubber compositions. Examples of the filler include reinforcing fillers such as mist silica, precipitated silica, carbon powder, titanium dioxide, aluminum oxide, quartz powder, talc, sericite, bentonite, or the like; fiber fillers such as asbestos, glass fiber, organic fibers or the like.

Examples of the catalyst, which is Component (D), include those any known as an addition reaction catalyst in the art. Specific examples of the catalyst include chloroplatinic acid, alcohol-modified chloroplatinic acid, complexes of chloroplatinic acid and olefins, platinum black or palladium supported on a carrier such as alumina, silica, carbon, or the like, and Group VIII elements of the Periodic Table or compounds thereof such as complexes of rhodium and olefins, chlorotris(triphenylphosphine) rhodium (an Wilkinson catalyst), rhodium (III) acetyl acetonate, or the like. It is solution with a solvent such as m-xylene hexafluoride, benzotrifluoride, or the like. The heat curing temperature and time can be suitably selected. The heat curing temperature and time can be suitably selected within the ranges of 100° C. to 500° C. and 5 seconds to 5 hours, according to a type of the belt, a process for manufacturing the belt, or the like.

A thickness of the layer of fluorocarbon siloxane rubber is not particularly limited. The thickness is preferably 20 μm to 500 μm, and more preferably 40 μm to 200 μm, so as to obtain good fixing properties for an image, with preventing toner separation and offset of the toner at the same time.

(Image Forming Apparatus)

Figure 2:
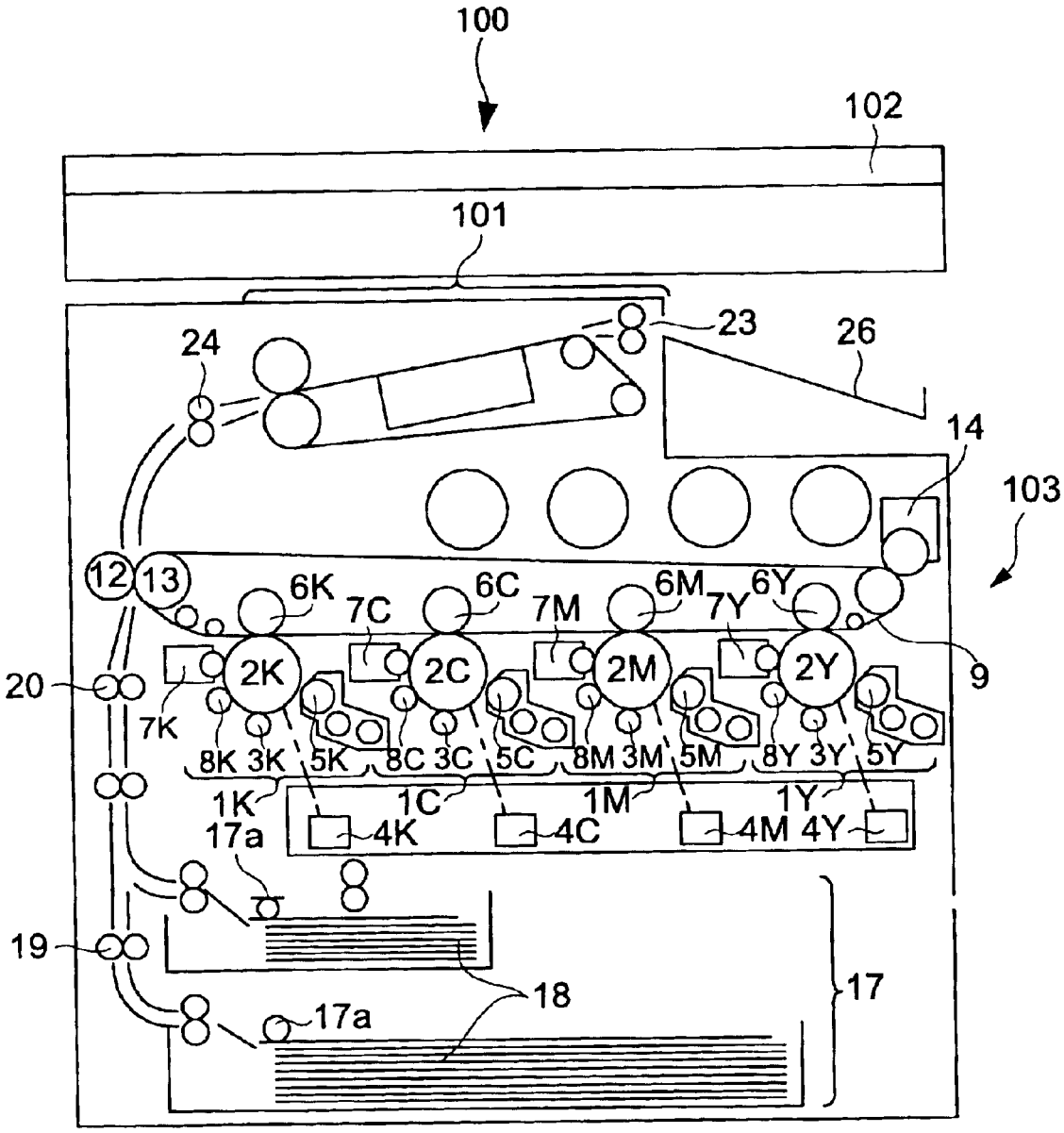
FIG. 2 is a schematic view of an example of an image forming apparatus of the present invention.

FIG. 2 is a schematic diagram of a color copying machine (image forming apparatus) constituting the electrophotographic printing system of the present embodiment. The copying machine 100 comprises a main body 103 and an image reader (document read means) 102. The main body 103 houses an image output section (image-forming section) and a image-fixing device 101.

The image forming section comprises an endless intermediate image transfer belt 9 which is spanned over plural tension rollers and is rotated, electrophotographic image forming units 1Y, 1M, 1C, and 1K, a belt cleaner 14 facing the intermediate image transfer belt 9, a secondary image transfer roller 12 facing the intermediate image transfer belt 9, sheet tray 17 for housing sheets of plain paper (image-receiving sheet) 18(S) and sheets of dedicated glossy paper (image-receiving sheet) 18(P), respectively, a pickup roller 17*a*, a pair of conveyer rollers 19 and 24, a pair of resist rollers 20, and a second paper output tray 26. The electrophotographic image forming units 1Y, 1M, 1C, and 1K are arranged from upstream to downstream of a rotation direction of the intermediate image transfer belt 9 and serve to form yellow, magenta, cyan, and black color toner images, respectively.

Each of the electrophotographic image forming units 1Y, 1M, 1C, and 1K comprises, for example, a photoconductive drum 2, an electrostatic charger roller 3, a development device 5, a primary image transfer roller 6, a drum cleaner 7, and a charge eliminating roller 8.

The belt image-fixing device 101 is arranged below the image reader 102 and above the image forming section (e.g., at image transfer position). The image-fixing device 101 is positioned directly above the image forming section (e.g., the intermediate image transfer belt 9) and directly under the image reader 102. The entire conveying path for the image-receiving sheet 18 extending from the second image transfer position to the image-fixing device 101 is positioned directly above the image forming section (e.g., the intermediate image transfer belt 9). A primary image-fixing line connecting between the secondary image transfer position and the primary image transfer position has a substantially normal vertical component. An image-fixing line connecting between the secondary image transfer position and the image-fixing position has a vertical component less than a horizontal component thereof. The image-receiving sheet 18 is ejected from the image-fixing device 101 to an area directly above the image forming section (e.g., the intermediate image transfer belt 9).

The configuration as above can yield the following advantages. Firstly, the entire apparatus 100 occupies as little space (in particular, as little footprint) as possible even though it comprises the image-fixing device 101. Secondly, the electrophotographic image-receiving sheet 18 is ejected at a relatively high position, and the apparatus can be operated easily.

The present invention will now be described in further detail with reference to the following Examples and Comparative Examples. The present invention is not limited thereto, however.

EXAMPLE 1

Support

Using a free sheet having a basis weight of 160 g/m$^2$ as raw paper, on the back side of the free sheet, a back-side polyethylene (PE) layer with thickness of 15 $\mu$m was formed by extrusion coating (310° C.) of a blend of high-density polyethylene (HDPE) and low-density polyethylene (LDPE) with a ratio of 7:3 (mass ratio). Next, on the front side was formed a front-side PE layer in the same manner so that LDPE is formed at a thickness of 31.7 $\mu$m, and thus a polyethylene laminated paper was made, which was used as a support. The light transmittance of the obtained support was measured with a direct reading hazemeter (HGM-2DP by Suga Test Instruments Co., Ltd.), and it was 12.1%.

Forming Front-side Undercoat 5 parts by mass of gelatin and 95 parts by mass of water are mixed and a front-side undercoat composition was prepared. On the front side of the support, the composition was coated and dried with a wire coater so that the amount of coating after being dried was 0.1 g/m$^2$, and thus the front-side undercoat was formed.

Forming of Back-side Layer 100 parts by mass of an aqueous acrylic resin (Hiros XBH-997L (Solids content 28.3% by mass) by Seiko Chemical Industries Co., Ltd.), 4.5 parts by mass of paraffin wax (Hydrin D-337 (solids content 30% by mass) by Chukyo Yushi Co., Ltd.), and 33 parts by mass of ion exchanged water were mixed and thus a back-side layer composition was prepared. On the back side of the support, the composition was coated and dried with a wire coater so that the amount of coating after being dried was 8.2 g/m$^2$, and thus a back-side layer was formed.

Forming of Intermediate Layer 100 parts by mass of water-dispersible acrylic resin (Hiros HE-1335 (Solids content 28.3% by mass) by Seiko Chemical Industries Co., Ltd.), 2 parts by mass of surfactant (Rapisol B-90 (solids content 10% by mass) by NOF Corp.), and 30 parts by mass of ion exchanged water were mixed and thus an intermediate layer composition was prepared. On the front side of the front-side undercoat, the intermediate layer composition was coated and dried with a wire coater so that the thickness of the coating after being dried is 5$\mu$m, and thus an intermediate layer was formed.

Forming of Toner Image-receiving Layer 100 parts by mass of water-dispersible polyester resin (Elitel KZA sample (solids content 30% by mass) by Unitika Ltd., glass transition temperature (Tg)=59° C.), 5 parts by mass of release agent (Carnauba wax by Chukyo Yushi Co., Ltd., Cellosol 524), 7.5 parts by mass of white pigment ($TiO_2$) aqueous dispersion (an aqueous dispersion of $TiO_2$ (Tipaque R780-2 by Ishihara Sangyo Kaisha Ltd.) and a macromolecular dispersant), 8 parts by mass of surfactant (Rapisol D-337 (solids content 10% by mass) by NOF Corp.), and a suitable amount of ion exchanged water is mixed, and thus a composition for toner image-receiving layer is prepared. On the intermediate layer, a composition for a toner image-receiving layer as described below was coated and dried with a wire coater so that the thickness after being dried was 7 $\mu$m, and thus an electrophotographic image-receiving sheet of Example 1 was made.

EXAMPLES 2–3 AND COMPARATIVE EXAMPLES 1–2

Electrophotographic image-receiving sheets of Examples 2 and 3 and Comparative examples 1 and 2 were made in the same manner as Example 1 except that the amount of surfactant was adjusted for each sheet to set the surface resistivities (SR1) according to Table 1.

<Evaluation>

For the electrophotographic image-receiving sheets made according to the Examples and Comparative examples as described above, a belt-fixing device shown in FIG. 1 which is incorporated in an electrophotographic apparatus, a modified full-color laser printer (DCC-500) by Fuji Xerox Co., Ltd., is used to conduct fixing treatments under the following conditions and evaluations were made. The results are shown in Table 1. The modified DCC-500 is covered entirely with a case except entrance and exit portions where an electrophotographic sheet enters and exits, and the dust-free air is supplied so that the inside of the case is positively pressured. In this case, the air cleanliness inside the case was class 1000.

Belt

Support of the belt: Polyimide film, width=50 cm, thickness=80 μm.

A predetermined amount of carbon black was mixed so that the surface resistivity (SR2) and volume resistivity (VR) were of the values as shown in Table 1.

Material of the release layer of the belt: SIFEL (fluorocarbon siloxane rubber precursor by Shin-Etsu Chemical Co., Ltd.), thickness=50 μm.

Heating Roller and Pressuring Roller

Temperature=140° C.

Cooling Process

Cooling device: Heat sink length=80 mm

Speed: 52 mm/sec

Passing time: 1.5 sec

<Measurement of Separation Electrified Charge>

Statiron-DZ3 by Shishido Electrostatic, Ltd.

<Surface Resistivity (SR) and Volume Resistivity (VR)>

Electrometer R-8340 by Advantest Corp. (in compliance with JIS K 6911)

<Positively Pressured Case>

Measured by a U-tube manometer.

<Occurrence Rate of Sheet Defects by Dust Adsorption>

Occurrence rate (%) of sheet defects by dust adsorption was obtained for 1000-sheet continuous feeding.

TABLE 1

| | | | Examples | | | Comp. Ex. | |
|---|---|---|---|---|---|---|---|
| | | | 1 | 2 | 3 | 1 | 2 |
| Image-receiving sheet | Amount of surfactant | g/m² | 0.15 | 0.15 | 0.15 | 0 | 0.15 |
| | SR1 (23° C., 55% RH) | Ω/cm² | $1.9 \times 10^{13}$ | $1.9 \times 10^{13}$ | $1.9 \times 10^{13}$ | $5.7 \times 10^{14}$ | $1.9 \times 10^{13}$ |
| Belt | SR2 (23° C., 55% RH) | Ω/cm² | $5.1 \times 10^{13}$ | $5.1 \times 10^{13}$ | $5.1 \times 10^{13}$ | $5.1 \times 10^{13}$ | $7.1 \times 10^{14}$ |
| | VR (23° C., 55% RH) | Ω · cm | $1.2 \times 10^{13}$ | $1.2 \times 10^{13}$ | $1.2 \times 10^{13}$ | $1.2 \times 10^{13}$ | $9.4 \times 10^{14}$ |
| Fixing speed | | mm/sec | 52 | 100 | 52 | 52 | 52 |
| Amount of separation electrification | Image-receiving sheet | kV | 0.5 | 0.8 | 0.6 | 5.2 | 5.6 |
| | Belt | kV | 0.7 | 1.6 | 0.6 | 5.3 | 6.1 |
| Pressure inside case | mmAq | 0 | 0 | 2.3 | 0 | 0 | |
| Defected sheets by dust adsorption (%) | 1000-sheet continuous feeding | | 0.4 | 0.6 | 0.1 | 1.5 | 1.8 |

As described above, according to the present invention, it is possible to effectively suppress generation of separation electrification between a belt surface layer and an image-receiving layer of an electrophotographic image-receiving sheet at a cooling and separating unit, prevent dust adsorption failure caused by charges at each surface, and print a high quality image having a near-photographic quality.

What is claimed is:

1. An image forming process comprising executing a fixing treatment to an electrophotographic image-receiving sheet using a belt-fixing smoothing device which comprises:

a heating and pressuring member;

a belt member;

a cooling device; and a cooling and separating unit, wherein a surface resistivity (SR1) of one side of the image-receiving sheet on which an image is formed satisfies the formula:

$$1.0\times10^{9}\ \Omega/\mathrm{cm}^2 \leqq SR1 \leqq 1.0\times10^{14}\ \Omega/\mathrm{cm}^2$$

and a surface resistivity (SR2) of one side of the belt member which becomes in contact with the image satisfies the formula:

$$SR2 \leqq 1.0\times10^{14}\ \Omega/\mathrm{cm}^2.$$

2. An image forming process according to claim 1, wherein a volume resistivity (VR) of the belt member satisfies the following formula:

$$1.0\times10^{9}\ \Omega\cdot\mathrm{cm} \leqq VR \leqq 1.0\times10^{14}\ \Omega\cdot\mathrm{cm}.$$

3. An image forming process according to claim 1, wherein an amount of charge of the belt member at the cooling and separating unit after being separated and an amount of charge of the electrophotographic image-receiving sheet at the cooling and separating unit after being separated are each ±5 kV or less.

4. An image forming process according to claim 1, wherein both of the belt member and the electrophotographic image-receiving sheet are discharged at the cooling and separating unit after being separated so that the amount of charge of the belt member and the amount of charge of the electrophotographic image-receiving sheet are each ±1 kV or less.

5. An image forming process according to claim 1, wherein the belt member comprises:

a support; and a surface coating layer on at least one side of the support, wherein the surface coating layer of the belt member which becomes in contact with an image contains fluorocarbon siloxane rubber.

6. An image forming process according to claim 5, wherein the fluorocarbon siloxane rubber comprises a main chain which contains at least one of perfluoroalkyl ether group and perfluoroalkyl group therein.

7. An image forming process according to claim 5, wherein at least one of the support and the surface coating layer of the belt comprises a conductive material.

8. An image forming process according to claim 7, wherein the conductive material comprises electron conductive particles, wherein a number average particle diameter thereof is 5 μm or less.

9. An image forming process according to claim 8, wherein the conductive particles are selected from the group consisting of carbon black, antimony oxide-doped tin oxide, tin oxide-doped indium oxide, Ni-plated polymer particles, Ag-plated polymer particles, and Au-plated polymer particles.

10. An image forming process according to claim 1, wherein the electrophotographic image-receiving sheet comprises:

a base; and at least one thermoplastic resin layer arranged on each side of the base, wherein a total thickness of the thermoplastic layers is 3 μm or more.

11. An image forming process according to claim 10, wherein at least one of the thermoplastic layers on the side on which an image is formed comprises a conductive material.

12. An image forming process according to claim 11, wherein the conductive material comprises electron conductive particles, wherein a number average particle diameter is 5 $\mu$m or less.

13. An image forming process according to claim 12, wherein the conductive particles are selected from the group consisting of carbon black, antimony oxide-doped tin oxide, tin oxide-doped indium oxide, Ni-plated polymer particles, Ag-plated polymer particles, and Au-plated polymer particles.

14. An image forming process according to claim 1, wherein the belt-fixing smoothing device further comprises a case which entirely covers the belt-fixing smoothing device except entrance and exit portions where an electrophotographic image-receiving sheet enters and exits the belt-fixing smoothing device, and dust-free air is supplied into the case so that the inside of the case is positively pressured.

15. An image forming process according to claim 14, wherein a cleanliness of the inside of the case of the belt-fixing smoothing device is class 10000 or better.

16. An image forming apparatus comprising a belt-fixing smoothing device so as to execute fixing treatment to an electrophotographic image-receiving sheet, the belt-fixing smoothing device comprising:

a heating and pressuring member;

a belt member;

a cooling device; and a cooling and separating unit, wherein a surface resistivity (SR1) of one side of the image-receiving sheet on which an image is formed satisfies the formula:

$$1.0\times10^{9}\ \Omega/\mathrm{cm}^2 \leqq SR1 \leqq 1.0\times10^{14}\ \Omega/\mathrm{cm}^2$$

and a surface resistivity (SR2) of one side of the belt member which becomes in contact with the image satisfies the formula:

$$SR2 \leqq 1.0\times10^{14}\ \Omega/\mathrm{cm}^2.$$

17. An image forming apparatus according to claim 16, wherein a volume resistivity (VR) of the belt member satisfies the following formula:

$$1.0\times10^{9}\ \Omega\cdot\mathrm{cm} \leqq VR \leqq 1.0\times10^{14}\ \Omega\cdot\mathrm{cm}.$$

18. An image forming apparatus according to claim 16, wherein an amount of charge of the belt member at the cooling and separating unit after being separated and an amount of charge of the electrophotographic image-receiving sheet at the cooling and separating unit after being separated are each ±5 kV or less.

19. An image forming apparatus according to claim 16, wherein both of the belt member and the electrophotographic image-receiving sheet are discharged at the cooling and separating unit after being separated so that the amount of charge of the belt member and the amount of charge of the electrophotographic image-receiving sheet are each ±1 kV or less.

20. An image forming apparatus according to claim 16, wherein the belt-fixing smoothing device further comprises a case which entirely covers the belt-fixing smoothing device except entrance and exit portions where an electrophotographic image-receiving sheet enters and exits the belt-fixing smoothing device, and dust-free air is supplied into the case so that the inside of the case is positively pressured.

21. An image forming apparatus according to claim 20, wherein a cleanliness of the inside of the case of the belt-fixing smoothing device is class 10000 or better.

* * * * *